US007040958B2

(12) United States Patent
Gan et al.

(10) Patent No.: US 7,040,958 B2
(45) Date of Patent: May 9, 2006

(54) TORQUE-BASED END POINT DETECTION METHODS FOR CHEMICAL MECHANICAL POLISHING TOOL WHICH USES CERIA-BASED CMP SLURRY TO POLISH TO PROTECTIVE PAD LAYER

(75) Inventors: Wee-chen Richard Gan, Santa Clara, CA (US); Karen Wong, Milpitas, CA (US); Kuo-Chun Wu, San Jose, CA (US)

(73) Assignee: Mosel Vitelic, Inc., Hsin Chu (TW)

( * ) Notice: Subject to any disclaimer, the term of this patent is extended or adjusted under 35 U.S.C. 154(b) by 0 days.

(21) Appl. No.: 10/851,378

(22) Filed: May 21, 2004

(65) Prior Publication Data

US 2005/0260922 A1 Nov. 24, 2005

(51) Int. Cl.
*B24B 49/00* (2006.01)

(52) U.S. Cl. ..... 451/8; 451/5; 451/41

(58) Field of Classification Search ..... 451/5, 451/6, 8, 41, 287, 288; 438/692, 693
See application file for complete search history.

(56) References Cited

U.S. PATENT DOCUMENTS 5,948,205 A * 9/1999 Kodera et al. ..... 156/345.13
6,234,878 B1 * 5/2001 Moore ..... 451/41
6,309,276 B1 * 10/2001 Tsai et al. ..... 451/5
6,494,765 B1 * 12/2002 Gitis et al. ..... 451/5
6,547,637 B1 * 4/2003 Zhang ..... 451/5
6,741,913 B1 * 5/2004 Wang et al. ..... 700/275
6,887,129 B1 * 5/2005 Birang et al. ..... 451/10
2003/0082996 A1 * 5/2003 Fortin et al. ..... 451/8

* cited by examiner

*Primary Examiner*—Dung Van Nguyen
(74) *Attorney, Agent, or Firm*—MacPherson Kwok Chen & Heid LLP; Gideon Gimlan

(57) ABSTRACT

A chemical mechanical polishing (CMP) method is disclosed in which a torque-based end-point algorithm is used to determine when polishing should be stopped. The end-point algorithm is applicable to situations where a ceria ($CeO_2$) based CMP slurry is used for further polishing, pre-patterned and pre-polished workpieces (e.g., semiconductor wafers) which have a high friction over-layer (e.g., HDP-oxide) and a comparatively, lower friction and underlying layer of sacrificial pads (e.g., silicon nitride pads). A mass production wise, reliable and consistent signature point in the friction versus time waveform of a torque-representing signal is found and used to trigger an empirically specified duration of overpolish. A database may be used to define the overpolish time as a function of one or more relevant parameters.

31 Claims, 9 Drawing Sheets

401

402

403

TORQUE-BASED END POINT DETECTION METHODS FOR CHEMICAL MECHANICAL POLISHING TOOL WHICH USES CERIA-BASED CMP SLURRY TO POLISH TO PROTECTIVE PAD LAYER

1. FIELD OF DISCLOSURE

The present disclosure of invention relates generally to Chemical Mechanical Polishing (CMP).

The disclosure relates more specifically to the mass production of semiconductor devices and to economical and precise chemical mechanical polishing of wafers with various CMP slurries including ceria-based CMP slurries. The disclosure relates yet more specifically to an operation known as torque-based end point detection.

2a. CROSS REFERENCE TO CO-OWNED APPLICATIONS

The following copending U.S. patent applications are owned by the owner of the present application, and their disclosures are incorporated herein by reference:

(A) Ser. No. 10/677,785 filed Oct. 1, 2003 by Kuo-Chun Wu et al and which is originally entitled, Multi-Tool, Multi-Slurry Chemical Mechanical Polishing; and (B) Ser. No. 10/851,549 by Kuo-Chun Wu et al and which is originally entitled, Pad Break-In Method for Chemical Mechanical Polishing Tool which Polishes with Ceria-based Slurry.

In order to avoid front end clutter, this cross referencing section (2a) continues as (2a') at the end of the disclosure, slightly prior to recitation of the patent claims.

2b. CROSS REFERENCE TO PATENTS

The disclosures of the following U.S. patents are incorporated herein by reference:

(A) U.S. Pat. No. 6,432,728 B1, issued Aug. 13, 2002 to Tai et al. and entitled Method For Integration Optimization By Chemical Mechanical Planarization End-point Technique;

(B) U.S. Pat. No. 6,612,902 B1, issued Sep. 2, 2003 to Boyd et al. and entitled Method And Apparatus For End Point Triggering With Integrated Steering;

In order to avoid front end clutter, this cross referencing section (2b) continues as (2b') at the end of the disclosure, slightly prior to recitation of the patent claims.

2c. CROSS REFERENCE TO PUBLISHED PATENT APPLICATIONS AND/OR OTHER REFERENCES

The disclosures of the following Published U.S. patent applications are incorporated herein by reference:

(A) U.S. 2003-0008597 A1, published Jan. 9, 2003, attributed to Tseng, Tung-Ching and entitled, Dual Detection Method for End Point in Chemical Mechanical Polishing;

(B) U.S. 2003-0181136 A1, published Sep. 25, 2003, attributed to Billett, Bruce H., and entitled, CMP Pad Platen with Viewport;

In order to avoid front end clutter, this cross referencing section (2c) continues as (2c') at the end of the disclosure, slightly prior to recitation of the patent claims.

DESCRIPTION OF RELATED ART

As its name implies, Chemical Mechanical Polishing (CMP) generally uses a combination of mechanical material removal and chemical material removal mechanisms for polishing the surface of a supplied workpiece towards achievement of a desired smoothness, planarity and/or thickness. Some forms of CMP rely more so on chemical removal mechanisms while other forms of CMP rely more so on mechanical and/or other removal mechanisms. By way of example, silica-based CMP slurries typically rely more on mechanical abrasion mechanisms for removing material while ceria-based CMP slurries typically rely more on chemical reaction and surface tension mechanisms for removing material and planarizing an under-polish surface. The material that is being removed can be an oxide-coating of a semiconductor wafer that has a planar or nonplanar surface topography.

When CMP is carried out, a slurry composed of mechanically-abrasive particles and/or chemically-reactive particles and/or surfactants and/or other materials is typically deposited onto a disk-shaped polishing pad. The polishing pad is typically rotated by a first electric motor while a mechanical engagement means brings the rotating pad and its CMP slurry into pressurized contact with the surface of a to-be-polished workpiece (e.g., a semiconductor wafer). A second electric motor typically counter-rotates the workpiece against the pad and slurry. A material removal mechanism begins to take place as components of the slurry interact chemically and abrasively with the surface material of the workpiece.

As polishing progresses, debris-containing old slurry is discharged from the rotating pad and fresh new slurry is continuously fed onto the pad to replace the discharged and old slurry. In a typical setup, the pad is mounted on a rotating platen so that the slurry-coated pad surface will move with uniform engagement against the counter-rotating workpiece. The to-be-polished surface of the workpiece is brought face-down into pressurized contact with the rotating and slurry-coated, polishing pad so that the slurry can remove surface material from the workpiece at a desired rate. At the end of the polishing process, the pressurized contact between pad, slurry and workpiece is undone and the workpiece is typically rinsed to remove left over debris and slurry material from its surface. The polishing pad may also be rinsed, reconditioned and/or loaded with fresh new slurry in between polishings. Typically, a same pad (e.g., one made of porous polyurethane) will be used to polish multiple batches were each batch consists of, say 10–25 workpieces.

The composition of the slurry is but one of a number of factors that generally determine the outcome of a chemical mechanical polishing operation. The composition and surface topography of the to-be-polished, workpiece surface can also be factors. The composition and surface topography of the polishing pad can be yet further factors. Friction between the pad and workpiece can change during polishing as the topographies and/or compositions and/or temperatures of the engaged surfaces (workpiece and pad) change. One type of end-point determining method tracks changes in the engagement friction between the workpiece and pad; and uses a unique part of the friction waveform to signal achievement of a specific state (e.g., attainment of first-order planarization.) It is referred to as torque-based end-point detection.

More broadly speaking, the decision of when to terminate a particular polishing operation can be made on the basis of a variety of parameters. Motor torque is just one example. A very simple determining algorithm can use polishing time alone as the determinant for when to end the polishing operation. A timer is started when contact pressure between the rotating pad, slurry and counter-rotating workpiece reaches a predefined threshold. The pressurized contact is undone when the timer indicates that a prespecified amount of time has elapsed. The magnitude of the timer's timeout value can be empirically developed.

More sophisticated polish termination techniques may use one or more, "end point" detection methods and optional timeouts following end-point detection. End-point detection may be based on force feedback (e.g., torque measurements), on optical characteristics of the under-polish workpiece (e.g., reflectivity), on acoustic characteristics of the under-polish workpiece, on chemical characteristics of the under-polish workpiece (e.g., debris analysis), and so forth.

One commonly used form of torque-based, end-point, detection relies on a surface area change occurring at the interface between the pad, slurry, and workpiece surface when the workpiece surface abruptly changes from having a substantially nonplanar topography (e.g., one having many hills and valleys resulting from, for example, trench isolation etching) to one having a substantially planar topography as the polishing process removes basically the last of the protruding major-sized features from the being-polished workpiece. Often, the torque between the pad and workpiece will increase dramatically at this stage as the surface contact area between the two increases with the achievement of first-order planarization. (Planarization may not yet be complete at this stage, but it will have reached a major milestone when the last of the major protruding features at a given order of dimensional magnitude are swept away.) The change in magnitude of torque can be fairly large and easy to detect if, for example, the workpiece had substantially vertical sidewalls and sharp corners in its trenches.

In the conventional implementation of such torque-based, end-point detection; electric power consumption (e.g., current consumption) by one or more of the pad-moving and workpiece-moving motors is measured as an indicator of motor torque. The motor is understood to be in a constant-velocity maintaining control loop. As friction increases, the motor typically needs more power to maintain its commanded velocity. (In some embodiments, the torque-indicating signal may be derived from the velocity feedback loop instead of directly from the motor's power lines.) A large and sudden increase in the motor's power demand may be used to indicate that first-order planarization has been achieved.

A major problem for this conventional, torque-based, end-point detection scheme is that not all workpieces arrive at the CMP station with nonplanar surface topographies. By way of example, in the above cited, co-owned U.S. application Ser. No. 10/677,785 (MULTI-TOOL, MULTI-SLURRY CHEMICAL MECHANICAL POLISHING), some workpieces are pre-polished in a first CMP tool before being transferred to a finer polishing station for final polishing (e.g., better planarization). The early-polish tools use silica-based slurries while the later, finer polishing stations use ceria-based slurries. Conventional, torque-based, end-point detection cannot be used in the second, finer polishing station because there is no longer a clear line of demarcation between one topographical state (stepped) and a second topographical state (unstepped) for determining when polishing should stop. Simple timeout could be used. However, the open-loop nature of the simple timeout technique makes it relatively imprecise. Closed-loop, end-point detection schemes are often better. It is therefore desirable to provide an end-point detection scheme that can be used in ceria-based chemical mechanical polishing irrespective of whether the incoming workpieces have topographical distinction (e.g., trenches for providing shallow trench isolation, STI), or not.

INTRODUCTORY SUMMARY

Structures and methods may be provided in accordance with the present disclosure of invention for realizing a torque-based end-point detection scheme that can be used in ceria-based chemical mechanical polishing irrespective of whether the incoming workpieces have topographical distinction (e.g., steps conforming to trenches that will be used for providing shallow trench isolation, STI), or not.

More specifically, a set of experiments were performed using STI wafers. Each STI wafer had a silicon nitride pad layer interposed between an overlying HDP-oxide layer and an underlying, silicon layer. It was shown that a consistently detectable and characteristic decrease in polishing friction occurred soon after the silicon nitride pad layer began to become exposed by ceria-based CMP polishing. A filtering algorithm was developed for detecting this signature decrease in polishing friction even in the presence of background noise.

A chemical mechanical polishing method in accordance with the disclosure may comprise the steps of: (a) using a ceria (CeO2) based CMP slurry and a polishing pad for chemical mechanical polishing (CMP) removal of a silicon oxide layer that is disposed on top of a silicon nitride layer within a supplied workpiece; (b) after first-order planarization of the silicon oxide layer is achieved, monitoring a signal indicative of engagement friction between the workpiece and the polishing pad; (c) after second-order planarization of the silicon oxide layer is indicated to have been achieved by said monitoring of the friction-indicative signal, continuing to monitor the friction-indicative signal for detecting a decrease-of-friction signature that is indicative on a mass reproducible basis, of a partial exposure state of the silicon nitride layer; and (d) in response to the detection of said decrease-of-friction signature, continuing to polish for a predefined time so as to fully expose the silicon nitride layer.

The step of detecting the decrease-of-friction signature may include the steps of: (c.1) defining a slope-determining window having a curve entry side where the curve entry side has a curve-entry point (e.g., a middle point of the curve entry side), and where the slope-determining window further has top and bottom curve exit sides of respectively defined widths, and where it yet further has a curve exit side of a respectively defined height with a midpoint opposite the curve-entry point; (c.2) testing the friction-indicative signal with at least three successive slope-determining windows to determine if there are at least 3 successive exits of the friction-indicative signal through the respective window bottoms of the at least three successive slope-determining windows; and (c.3) identifying the last exit of the friction-indicative signal curve through the last of the at least three successive slope-determining windows as being the time point where said partial exposure state of the silicon nitride layer is deemed to have occurred.

A chemical mechanical polishing (CMP) tool in accordance with the disclosure may comprise: (a) at least one port for receiving a ceria ($CeO_2$) based CMP slurry; (b) a port for receiving a rinsing fluid; (c) a platen for receiving and supporting a polishing pad; (d) a carrier for receiving and supporting a to-be-polished workpiece, where the to-be-polished workpiece can have a to-be-thinned silicon oxide layer that is disposed on top of a silicon nitride layer, where at least one of the platen and carrier is motor driven for creating moving and frictional engagement of the polishing pad with the to-be-polished workpiece; and (e) an automated workflow controller which is operatively coupled to one or more motor drives of the platen and/or workpiece carrier for receiving a friction-indicative signal indicating a relative magnitude of moving friction between the platen and carrier, where the workflow controller further includes a polish terminating subsystem having: (e.1) a first monitoring means for monitoring the friction-indicative signal after first-order planarization of the silicon oxide layer has been achieved, (e.2) a planarization improving means for causing continued and more planar polishing of the silicon oxide layer, (e.3) a second monitoring means for continuing to monitor the friction-indicative signal for detecting a decrease-of-friction signature that is indicative on a mass reproducible basis of partial exposure state where the silicon nitride layer is partially exposed through the silicon oxide layer; and (e.4) an over-polish means for continuing to polish for a predefined time after detection of said decrease-of-friction signature, so as to fully expose the silicon nitride layer.

Other aspects of the disclosure will become apparent from the below detailed description.

BRIEF DESCRIPTION OF THE DRAWINGS

The below detailed description section makes reference to the accompanying drawings, in which.

DETAILED DESCRIPTION

Figure 1A:
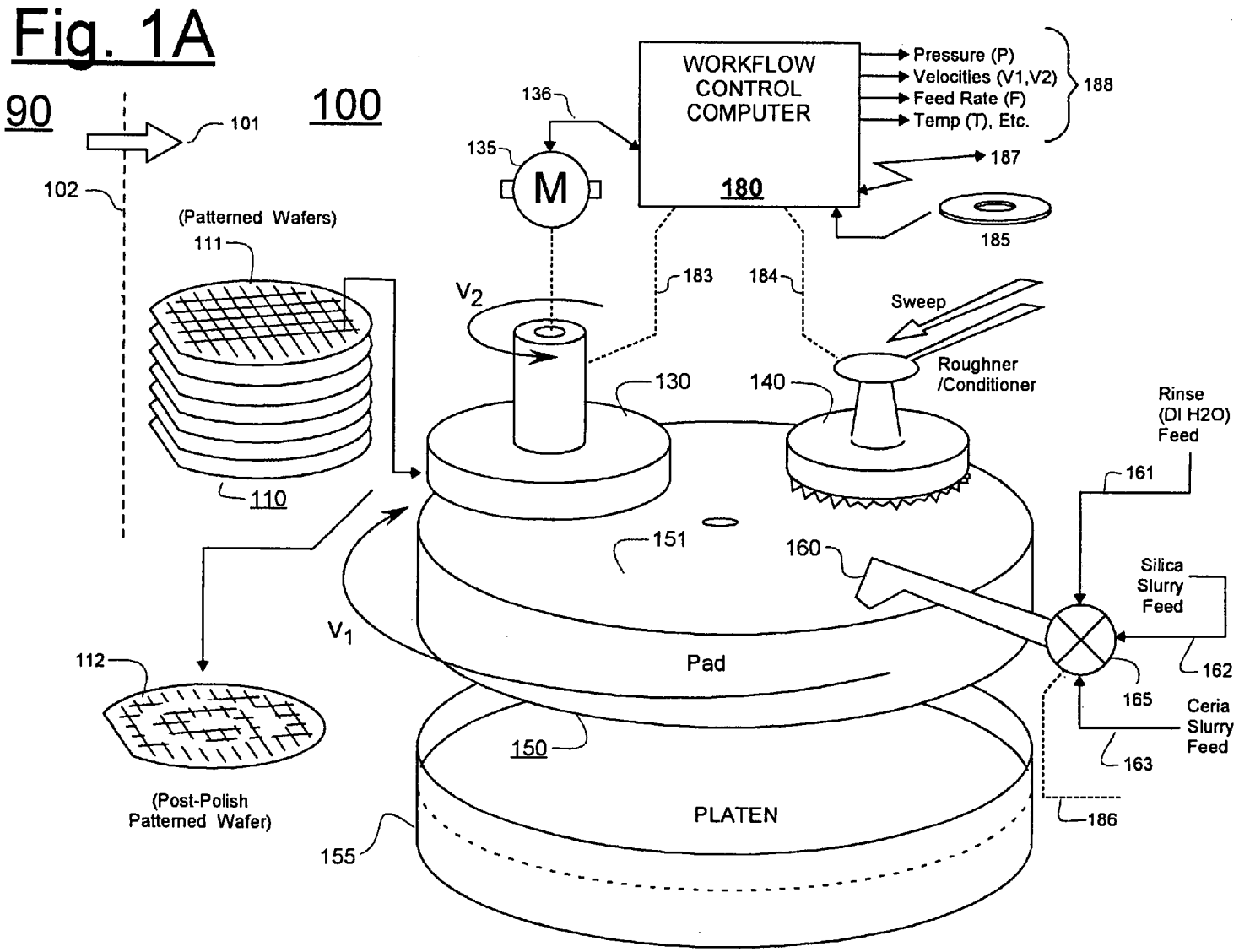
FIG. 1A is a schematic diagram illustrating parts of a CMP tool which uses a polishing pad and a ceria ($CeO_2$) based CMP slurry to polish supplied batches of workpieces and which also may use a silica ($SiO_2$) based CMP slurry for other operations.

FIG. 1A is a schematic diagram of a chemical mechanical polishing (CMP) tool 100 that may be used as part of a mass production line which processes large numbers of to-be-polished workpieces. Workpieces are typically supplied in batches to the tool and these batches may include the illustrated batch 110 of patterned STI wafers (shallow trench isolation wafers). Those skilled in the art of mass production will appreciate that it is desirable to have relatively consistent polishing results from one batch of workpieces to the next, and also as between workpieces within a batch and also across the operative surface area of each wafer. In FIG. 1A, a pre-patterned batch 110 of semiconductor wafers is shown to have entered (101) the polishing tool 100 from an external location 90 by way of a sealable transfer boundary 102 of the tool. The illustrated CMP tool 100 generally uses a periodically replaced, polishing pad 150 and a supplied flow of ceria ($CeO_2$) based CMP slurry (162) or silica-based ($SiO_2$) CMP slurry to polish in-transferred batches of workpieces. In one embodiment, a silica-based CMP slurry is used to polish an upper part of each wafer while a ceria-based slurry is used to better planarize and further polish each, silica-polished wafer.

Different arrangements are possible for rubbing slurry across the to-be-polished surface of each workpiece. In the illustrated example, a rotatable platen 155 supports a replaceable polishing pad 150. (The platen is shown exploded away from the pad for illustration purposes.) An independently rotatable carrier 130 grabs respective ones of the in-transferred workpieces (e.g., patterned semiconductor wafers such as top-of-batch wafer 111) and brings them into face-down pressurized contact with a working surface 151 of the rotating polishing pad 150. A first electric motor 135 rotates the carrier 130. The first electric motor 135 is under operative control of a workflow control computer 180 (via control link 136). The computer 180 may be programmed to command the first electric motor 135 into a constant velocity regime, such as to rotate the carrier at a pre-specified angular velocity, $V_2$.

Further electric, or other kinds of motors (not shown) may be used to move further parts of the CMP tool 100. These other, moved parts may include but are not limited to the platen 155 and a conditioning disk 140. A fluid dispensing arm 160 delivers selected ones of a rinse fluid 161 (e.g., DeIonized water), a silica-based slurry 162, and/or a ceria-based slurry 163 to the working surface 151 of the polishing pad. A computer-controlled valve 165 may be used to determine which of the fluids 161–163 will be dispensed and when. Electrical link 186 carries valve control signals from the workflow controlling computer 180. (As used herein, silica-based CMP slurries refer to any one or more mixtures which include a substantial amount of $SiO_2$ particles for carrying out a chemical mechanical polishing process. Further as used herein, ceria-based CMP slurries refer to any one or more mixtures which contain a substantial amount of $CeO_2$ particles for carrying out a chemical mechanical polishing process).

The exemplary CMP tool 100 may further include a diamond studded roughening/conditioning disk 140 for sweeping across the working surface 151 of the pad and for roughening and/or conditioning the working surface 151 during pad break-in and/or conditioning operations. Other forms of roughening/conditioning means in addition to, or as alternatives for the diamond studded and/or disk-shaped kind (140) may of course be used. Moreover, movement of the workpieces relative to a polishing pad surface and to the slurry can be realized by way of linear motion (e.g., a polishing belt) in addition to or as alternates to the illustrated rotary motion. The present discussions are not limited to rotary machines.

In one embodiment, a silica-based slurry (162) is used for pad break-in even if a ceria-based slurry (163) is to be used for subsequent polishing of the patterned wafers 110. An electrical link for controlling the roughening/conditioning disk means 140 is shown at 184. An electrical link for controlling up and down movement of the workpiece carrier 130 is shown at 183. The control computer 180 may be operatively coupled to various other parts of the CMP tool 100 for sending control commands to the tool and/or receiving sensor signals from the tool. One or more computer programs 185 may be loaded into the control computer 180 from tangible computer media (e.g., CD-ROM disk) and/or from a communications network 187 in the form of manufactured instructing signals so as to cause the computer 180 to carry out operations described herein.

For purpose of illustration, a brief description is provided here of a two-step polishing operation on a given STI wafer 111. The first step uses a silica-based slurry for partially planarizing the wafer 111 to a first-order degree while the second polishing step uses a ceria ($CeO_2$) based CMP slurry to further planarize the partially planarized wafer to a higher order of planarization. The supplied wafer 111 may be one that has a monocrystalline semiconductor substrate (e.g., silicon) and various other material layers formed on the substrate, including a CVD-deposited silicon nitride layer (not explicitly shown in FIG. 1A, see instead FIG. 2A) and a High Density Plasma (HDP) oxide layer deposited on top of the nitride layer. The HDP oxide fills a patterned plurality of tiny trenches so as to provide Shallow Trench Isolation between active devices (e.g., transistors) which will be later created in the wafer. Areas of the substrate where the active devices will form are covered by a sacrificial pad material such as silicon nitride. Other compositions of trench-filling insulative material and substrate-protecting, pad material are possible. The illustrated CMP tool 100 is to be used to precisely and finely polish away at least a portion of the HDP oxide which directly lies on top of the silicon nitride, pad layer. This fine polishing step is intended to fully expose and finely planarize the underlying nitride layer without eroding away too much of the nitride layer or causing too much dishing of the HDP-oxide material which is still present in adjoining trenches. As will be seen, it is a challenge to do so with consistent precision in a mass production environment.

When incoming workpieces are moved into the tool 100, the workpieces are typically transferred in (101) as batches of many alike workpieces. After the polishing of each workpiece completes, the post-polish workpiece (e.g., polished wafer 112) is held over inside the tool until an accumulated batch of post-polish workpieces forms inside the tool 100. The post-polish batch is then transported outside through the tool's sealable boundary 102. Typically each inloaded or out-transferred batch of workpieces (e.g., 110) will have 10 or more workpieces. A common number is 25 workpieces per batch. Unpatterned, dummy-wafers (not shown) may also be transferred into the tool 100 in batches for pad break-in purposes.

Despite its apparent simplicity, the CMP tool 100 may have many variable parameters that need to be controlled in order to provide a desired polishing action. These controllable variable parameters 188 may include: polish contact pressure (P), pad velocity (V1), carrier velocity (V2), slurry feed rate (F), contact surface temperature (T), slurry composition (186), rinse feed rate (R), and the lengths of time and sequences in which various actions occur. The workflow control computer 180 and its inloaded software and/or computer data (185, 187) are typically made responsible for managing such variable parameters. It is within the contemplation of the disclosure that plural automated machines (e.g., digital processors) may be used instead of just a centralized one.

Figure 1B:
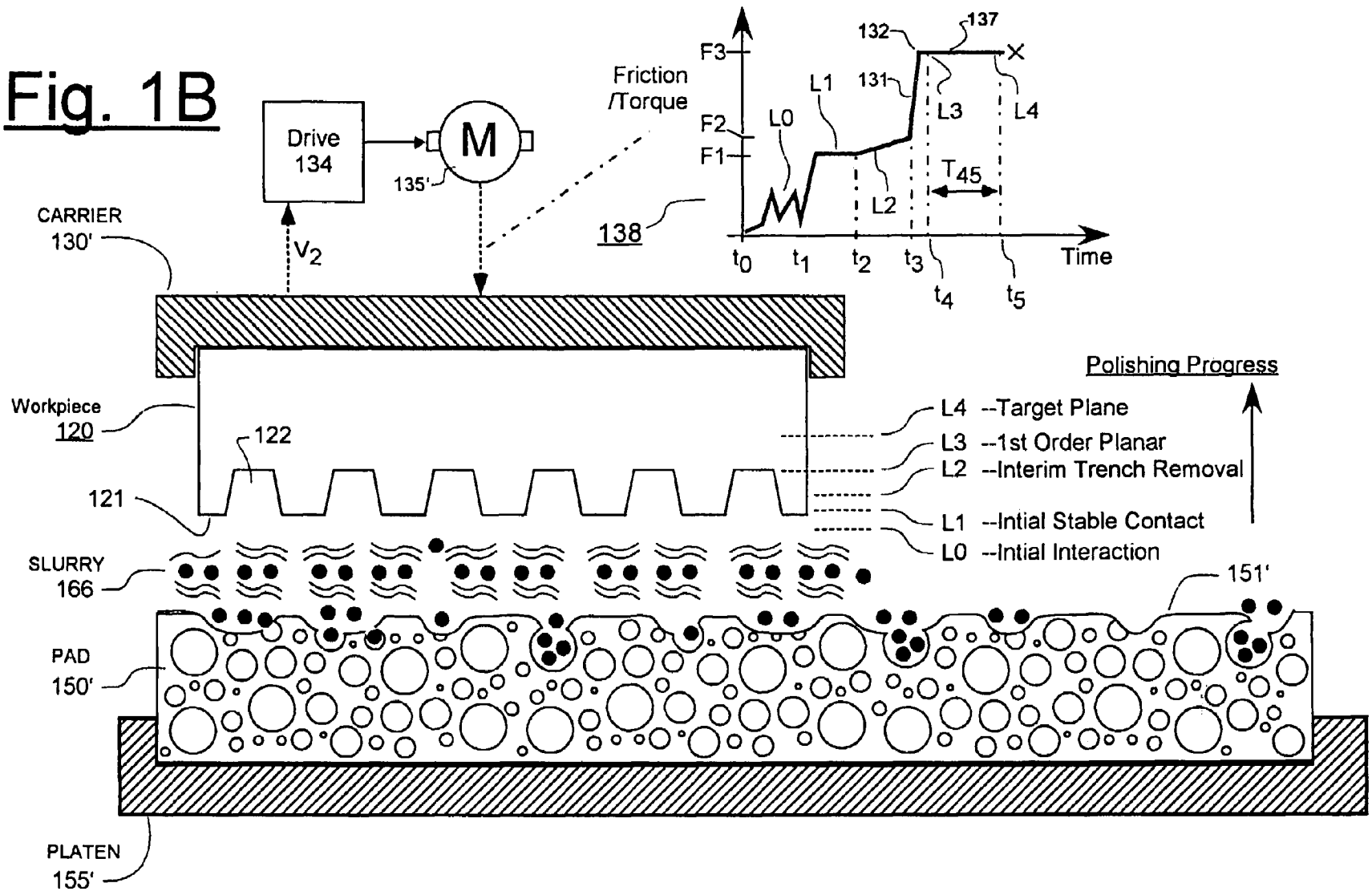
FIG. 1B is a schematic cross sectional view for explaining possible interactions between pad, slurry, and a topographically variant wafer as polishing progresses and the wafer becomes more and more planarized.

Referring to FIG. 1B, a not-to-scale, schematic cross-sectional view is provided for explaining some additional nuances of the chemical mechanical polishing process. A platen-supported pad, 150' may initially have a fairly planar and smooth surface prior to roughening, with just a few pockets or voids being opened and exposed at its top surface. After an in-tool roughening operation, the surface 151' of the pad 150' will usually have a statistically uniform distribution of additional grooves, channels, or other kinds of surface voids and/or indentations defined uniformly across its working surface for containing and moving the tool-supplied slurry 166. This combination of slurry 166 and pad surface 151' spins and begins to interact with a face-down surface 121 of the carrier-supported and supplied workpiece 20 as the carrier 130' lowers the workpiece (in this case, a semiconductor wafer having pre-formed trenches 122) into pressurized contact with the spinning polishing pad 150'. Friction between the workpiece and the combination of pad plus slurry will be seen as a torque load by the motor 135' that is rotating the carrier 130'. A representative, friction versus time graph is shown at 138.

Typically, an electronic drive circuit 134 will be trying to drive the motor 135' so as to effectuate a constant rotational velocity $V_2$ for the carrier 130'. Power sent to the motor usually increases as frictional resistance from the counter-rotating pad increases. The motor's power consumption correspondingly decreases when torque on the motor shaft decreases.

A common way to measure motor torque is to measure the motor's power consumption, usually by measuring motor current if voltage is held constant. It may be seen in the representative, friction versus time graph at 138 that friction is initially zero at a first time point, $t_0$ before the pad and workpiece have made any interactive contact. Between time points $t_0$ and $t_1$, the frictional force fluctuates somewhat randomly as the slurry 166 begins to interact with topographical surface features of the workpiece surface 121. This initial, frictional interaction is referred to herein as the level L0 interaction.

Eventually, a first stable interacting state L1 will be obtained between the compressively engaging pad and workpiece. The frictional force of this first stable level L1 is referenced as F1. The area of contact between the pad and workpiece surface 121 is assumed to be relatively constant during the L1 phase and the friction force, F1 therefore remains relatively constant between corresponding time points, $t_1$ and $t_2$. It is assumed in this example, that the trenches 122 of the given wafer 120 taper to smaller widths when measuring from the wafer's initial upper surface 121 (at level L1) towards a deeper, target plane, L4. As a result, between time points $t_2$ and $t_3$, when polishing has progressed to an intermediate level L2, it is seen that frictional force has linearly increased from the F1 level to the F2 level. This occurs because the area of contact between the pad and workpiece surface 121 is linearly increasing with the linearly reducing widths of the tapered trenches 122.

At some point in time, say $t_3$, the combination of pad and slurry 150'/166 will come into full-area engagement with the trench bottoms (level L3) and the area of contact between the pad and workpiece will increase dramatically, say between time points $t_3$ and $t_4$. It is seen in representative plot 138 that the frictional force has correspondingly increased in dramatic fashion in region 131 of its waveform, from the F2 magnitude to the F3 magnitude. This happens as planarization improves substantially when the polishing front reaches the L3 level at the time point $t_4$ corresponding to the top 132 of the sharp rise 131. This is not to say that planarization at the L3 level is totally complete and perfect. There are usually many microscopic hills and valleys still present on the surface of the workpiece, but at spatial dimensions which are one or more orders of magnitude finer than the hills and valleys recently defined by the polished-away trench features 122. The planarization which is achieved at the L3 level may be referenced as a first-order planarization. There will often be higher orders of planarization to achieve as polishing continues from the first-order level L3, towards the target level, L4.

Typically, attainment of the first-order planarization level, L3 is detected by detecting the dramatic increase 131 in motor torque from the relatively smaller, F2 magnitude to the much larger, F3 magnitude. In response to this dramatic increase 131, an empirically-established knowledge base is consulted, and a constant overpolish time, $T_{45}$ is set for continuing the polishing from the L3 level down to the targeted L4 level. Contact pressure between the pad and workpiece is undone when the preset time length, $T_{45}$ runs out. Plot 138 indicates that the frictional force between corresponding time points $t_4$ and $t_5$ is expected to remain roughly constant (at about F3) in graph region 137 as the polishing proceeds from the L3 level to the targeted L4 level. Actually, the frictional force should increase slightly as the amount of planarization improves and thus the effective contact surface area between the pad plus slurry (151'/166) and the workpiece surface increases. However, the increase usually occurs on a smaller scale of magnitude in region 137 than that shown by plot 138. It is not nearly as large as the magnitude delta between the F2 and F3 force values.

Figure 1C:
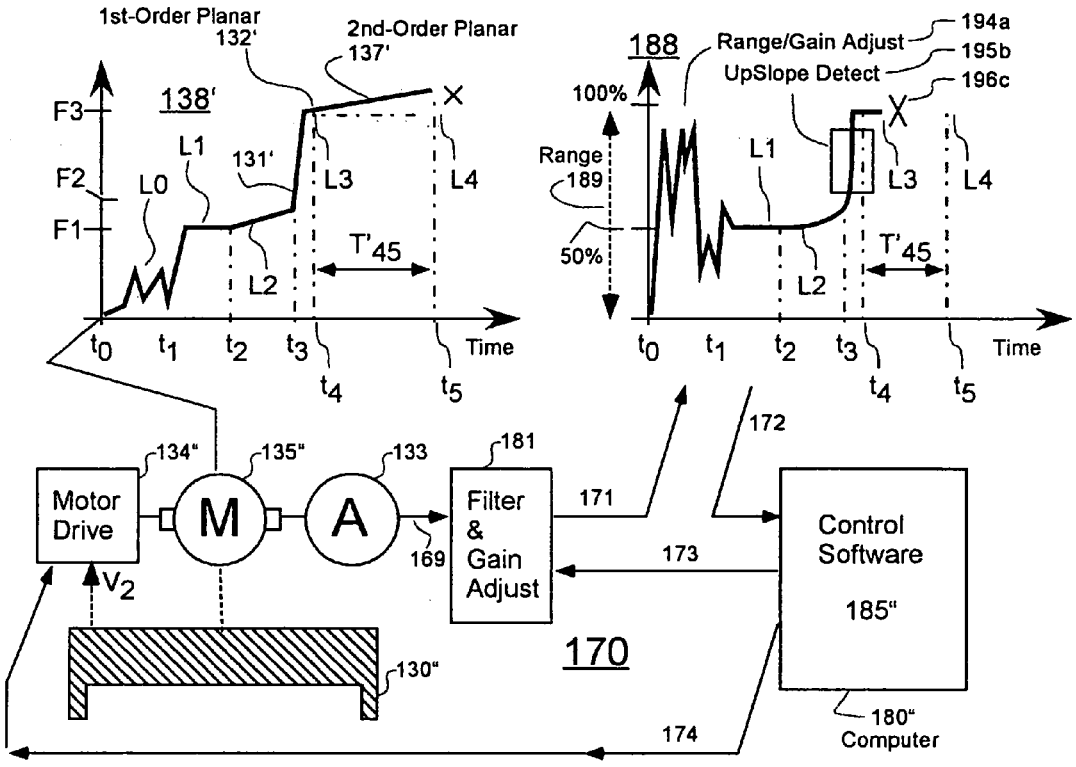
FIG. 1C is a schematic diagram for illustrating, among other things, a conventional method for detecting the achievement of first-order planarization.
Figure 1D:
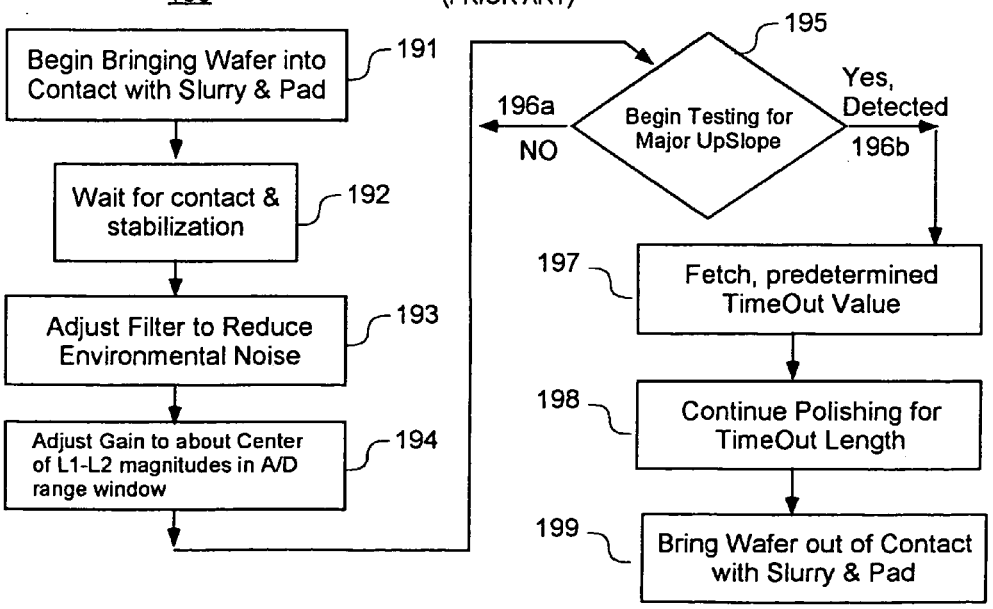
Fig. 1D (PRIOR ART)
FIG. 1D is a flow chart of an automated method for achieving second-order planarization using the first-order detecting apparatus of FIG. 1C.

FIGS. 1C and 1D provide a more detailed look at how the delta between the F2 and F3 force magnitudes may be detected conventionally. (Note however, that the hardware system 170 shown in FIG. 1C may alternatively be used in combination with novel software for carrying out polishing in accordance with the present disclosure, and therefore, FIG. 1C does not necessarily represent only the conventional approach.) Referring to the combination of system diagram (170) and plots (138', 188) as shown in FIG. 1C, it is seen that an ammeter (A) 133 detects current drawn by the carrier motor 135". The ammeter supplies a magnitude-indicating signal 169 to a signal filtering and amplifying circuit 181. The front end of circuit 181 may include an analog-to-digital converter (A/D, not explicitly shown). Alternatively, ammeter (A) 133 may provide a digital signal (169) for indicating the magnitude of motor current, in which case the A/D conversion gain and range of the ammeter 133 should be controllable by computer 180". In the illustrated embodiment, noise filtering, gain adjusting and offset bias adjusting functions of circuit 181 are under control (via link 173) of software 185" installed in the workflow control computer 180". As the carrier 130" begins to rotate the workpiece frictionally against the pad and slurry (not shown), the control software 185" adaptively adjusts at least the offset or gain parameter, if not also the filtering parameters, of circuits 181 and/or 133 to establish an appropriate observation range 189 for the digital, force-indicating signal 171 output by circuit 181. The domain, range and gain adjustments are typically made during time period $t_0$–$t_1$ so as to roughly position the L1 and L2 magnitudes of the force-indicating signal 171 into the middle or lower half (e.g., 25% of full range) of the observation window range 189. The filtering parameters of circuit 181 may be pre-established and/or they may be adaptively adjusted in real time to reduce noise from sources inside or external to the polishing tool (100). Gain adjustment is stopped well before the expected time, $t_3$ of the sharp transitioning 131' to first-order planarization (132', at depth level L3). It is often the case in mass production environments that relatively similar batches of incoming wafers are polished. A rough approximation can therefore be empirically determined of the time, $t_3$ when the sharp transition 131' will occur.

Plot 188 provides a general picture of what the digital sample value signals may look like when received (172) by the control software 185" of the computer as friction correspondingly changes in plot 138' and as gain and offset adjustments converge prior to the expected time, $t_3$ of the dramatic transition 131' of the engagement friction. A respective software process 190 is flow charted in FIG. 1D. At step 191, the computer 180" causes an STI wafer (e.g., 120 of FIG. 1B) to come into frictionally rubbing engagement with the pad and slurry. In step 192, the computer waits for detection of frictional contact and stabilization of the interaction (the beginning of level L1). In step 193, the computer may make optional, adaptive adjustments to the noise filtering functions of circuit 181 to improve signal-to-noise ratio. In step 194, the computer makes the assumption that the L1 beginning level has been achieved and the control software 185" begins to adjust the gain and optional offset of output signal 171 so as to bring the L1 and/or L2 magnitudes roughly into the middle of, or lower quarter of the full A/D range window 189. This convergence is also represented by waveform portion 194*a* of plot 188.

After the gain and/or offset adjustments have been finalized, process 190 continues on to step 195 where the received (172) sample values that indicate the magnitude of friction to the control software 185" are tested to detect a major increase (131', 195*b*) in slope versus time. A variety of different, machine-implemented algorithms may be employed for detecting this major upswing. Such tests should, of course, discount minor upswings due to noise or due to minor and slowly creeping-up values in the stream of incoming, friction sample values. If the major increase in slope versus time is not detected, loop-back path 196*a* is taken and the testing and waiting continues. When the major increase finally is detected, path 196*b* is taken. At this point in time, there is no need for the software to continue monitoring 172 the sample value signal 171 being produced by circuit 181. Therefore the software 185" stops watching. This cessation of monitoring is represented by the "X" icon 196*c* in plot 188. Box 195*b* indicates the general waveform portion of the samples waveform where the major slope increase is detected.

As soon as the major slope increase is detected (196*b*), the software jumps to step 197 where it fetches a pre-established timeout value and applies it to a timer means (e.g., a real time timer circuit). This timeout value ($T'_{45}$) has been empirically predetermined in view of the polishing rate of the tool under current conditions (P, V1, V2, etc. plus material being polished) so that a relatively constant thickness of further polishing will occur beyond the moment of upswing detection to bring the polishing process to the desired target level (e.g., L4 of FIG. 1B). Step 198 represents the continuing of the polishing under the current tool conditions (P, V1, V2, etc.) for the duration of the timeout value. As soon as the timeout length ($T'_{45}$) runs out, the software algorithm (190) jumps to step 199 where it reduces the contact pressure between the workpiece and the combined pad and slurry so as to bring the polishing process to a halt at a depth very close to the desired target plane, L4. The contact discontinuation command may be sent via link 174 of FIG. 1C.

It is to be noted in plot 138' of FIG. 1C that friction often continues to rise, albeit more slowly, after the major slope increase is detected at region 195*b* of plot 188. The continued increase of friction (137') is typically due to the polishing process making a transition from a first-order planarization state to a second-order planarization state. Surface contact area is slightly greater in the second-order planarization state. The control software 185" does not respond to this subsequent increase of friction however, because monitoring has stopped at the point indicated by the "X" 196*c* of plot 188.

Figure 3A:
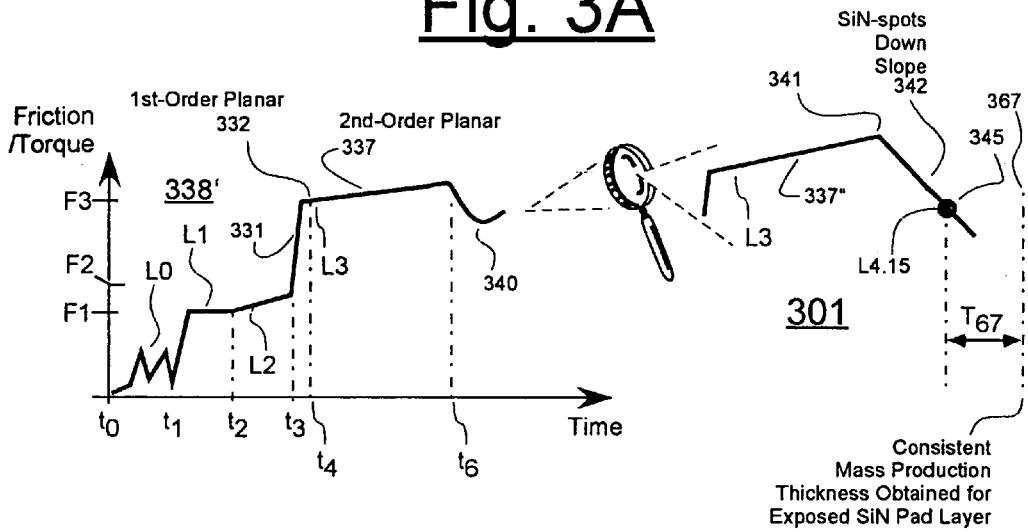
FIG. 3A is a time versus friction plot for showing conceptually and on a first-order approximating level what happens as second-order planarization is followed by increasing exposure of surface regions of the silicon nitride stop layer.

In certain cases, there can be yet further changes in the observed friction (or motor torque) following the second-order planarization rise (e.g., 137' of FIG. 1C). The wafer-to-pad friction (or motor torque) can start to decrease if the slurry begins to interact with a newly-exposed, material layer that has a relatively lower coefficient of friction than did the already exposed material. The coefficient of friction may depend on what kind of CMP slurry is being used (e.g., a ceria-based or a silica-based slurry) and what the newly exposed, material layer is. Referring briefly to FIG. 3A, such a signature reduction in friction is seen at 340 (time point $t_6$), following the second-order planarization rise of region 337.

Figure 2A:
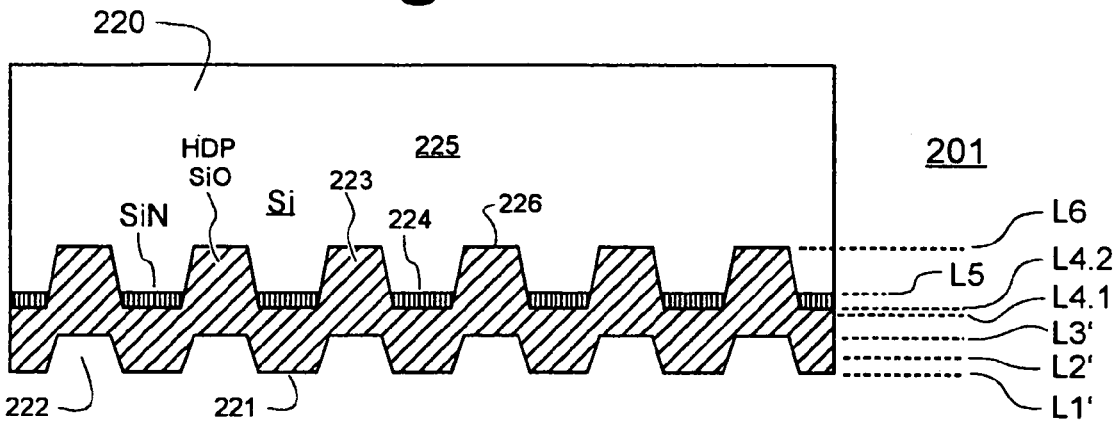
FIG. 2A is a schematic cross sectional view showing a first step in planarizing an STI wafer down to a silicon nitride stop layer.
Figure 2B:
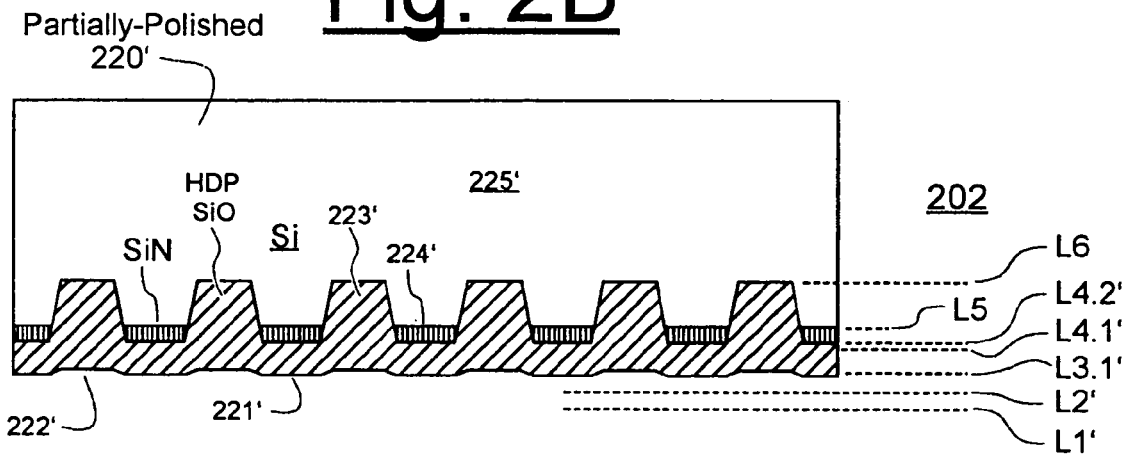
FIG. 2B is a schematic cross sectional view showing a subsequent state of FIG. 2A, or in the alternate, an incoming and pre-polished wafer STI wafer which is to be further planarized down to its silicon nitride stop layer.
Figure 2C:
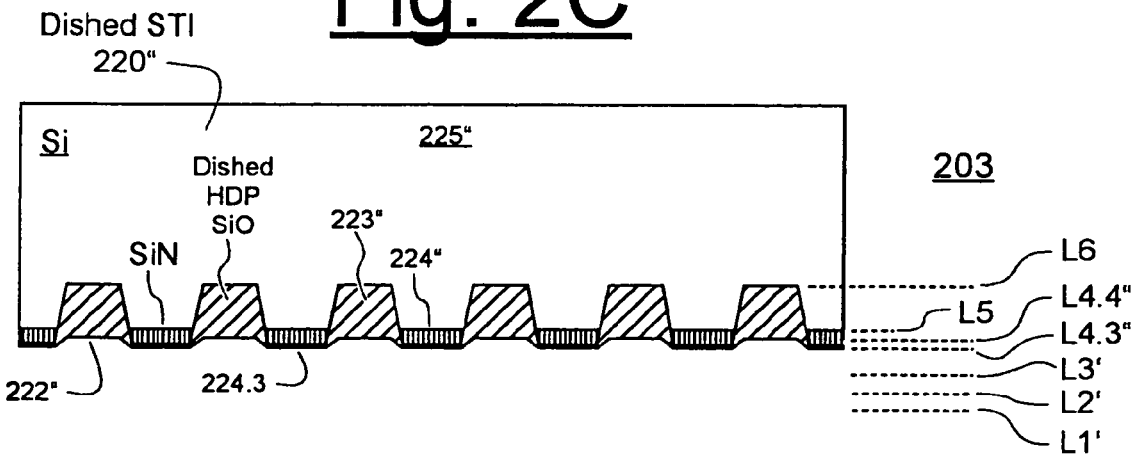
FIG. 2C is a schematic cross sectional view showing a possible further state for the wafer of FIG. 2A or 2B wherein dishing causes deplanarization of the wafer surface.

Before going further with a description of FIG. 3A, an examination is made in FIGS. 2A–2C of characteristics of a wafer that includes a reduced-friction layer beneath (224) its initially polished surface (221). FIG. 2A is a schematic cross sectional view showing a first step 201 in the planarizing a supplied STI wafer 220. The supplied wafer 220 has a nonplanar, initial upper surface 221 characterized by many trenches 222 of relatively large size. This initial upper surface 221 is composed primarily of a silicon oxide material (e.g., HDP-oxide) 223 which was earlier deposited conformably over a silicon substrate 225. The substrate 225 has trenches 226 (for use in Shallow Trench Isolation) defined in it. Sacrificial, silicon nitride pads 224 are defined on top of the mesas, where the mesas result from formation of the isolation trenches 226. The deposited oxide 223 conformably coats over the substrate trenches 222 and the nitride pads 224.

Using the nomenclature developed above for FIG. 1B, the CMP polishing process of FIG. 2A can be described as follows. When polishing begins to make stable frictional engagement with the trench-fill material 223 (e.g., HDP-oxide) at the L1' level, a first magnitude of friction (F1) develops. As the trench-fill material 223 is removed and the slurry advances to the L2' intermediate level, the amount of friction between the interacting wafer and slurry may change slightly (e.g., rise to F2) if the oxide trenches 222 are tapered. First-order planarization is achieved when the slurry advances to the L3' level, and the amount of friction between the interacting wafer and slurry typically increases dramatically at this stage (to the F3 magnitude as shown in FIG. 3A). The slurry continues to provide polishing action beyond the L3' level, and as it does so, second-order or higher degrees of planarization may be achieved, particularly if a ceria-based slurry or a like, fine polishing medium is used. Friction continues to rise or stabilize (plateau) as the polishing front advances to a level, L4.1 just a few Angstroms away from the tops of the silicon nitride pads 224. The desired, end-of-polish plane is L4.2, which is the level where essentially all of the silicon oxide on top of the nitride pads 224 has been removed, and the tops of the nitride pads 224 are essentially fully exposed, but where the thicknesses of respective ones of the nitride pads across the wafer have not been substantially reduced from their original thicknesses.

The described, L4.2 end-of-polish, target plane is very difficult to attain in practice. There are several reasons. First, thickness from the L1' level to the L4.2 level can vary in mass production. In one embodiment, the nominal thickness between L1' and L4.2 is around 6000 Å but it can vary over a range of say, between about 5500 Å to about 6500 Å. A second reason is that heretofore, methods were not known for reliably, consistently and precisely detecting a transition point between the L4.1 level and the L4.2 level, particularly when ceria-based slurries are used. Often the thickness of the silicon nitride pad layer 224 is relatively small, say on the order of about 700 Å–1000 Å (from the L4.2 level to the illustrated L5 level). A 10% deviation in locating position within the 6000 Å thick oxide layer could translate to a more than 50% positioning error (e.g., 600 Å) in the 700–1000 Å thick nitride layer. This is a large variation and can be unacceptable for subsequent processing. A third reason for difficulty is that uniformity across the wafer surface is difficult to maintain. Some CMP tools or polishing processes tend to overpolish more so in one geometric area of the wafer (e.g., near the center) and/or to underpolish more so in another area (e.g., near the periphery). Such nonuniform behavior can pose a problem for obtaining consistent results across the entire operable surface area of the wafer.

FIG. 2B is a schematic cross sectional view showing at least two possible situations, 202. In one scenario, the STI wafer 220' had been pre-polished to the L3.1' level in a separate tool, for example, one that uses a different CMP slurry composition (e.g., silica instead of ceria). In another scenario, the STI wafer 220' had been first polished in the current tool (100) with a first CMP slurry composition (e.g., a silica-based slurry) down to the L3.1' level and now the same tool (100) is being switched over to a mode of operation where it will be using a more-planarizing slurry composition (e.g., a ceria-based slurry) for continuing the polishing, with better planarity, down to the L4.2' target level.

Under any of scenarios 202, the topographical differentiation that was available upon encountering the bottom flats of fill-trenches 222 (FIG. 2A) is no longer available because those trench bottoms 222' are now substantially co-planar with other surface areas 221' of the trench-fill material 223' (e.g., HDP-oxide). A new method has to be devised for determining when the to-be-commenced polish at the L3.1' level is advancing through the region between L4.1' and L4.2'. It is important to assure that the polishing will not advance into the L5 level or deeper because that is where active devices (e.g., transistors) will be formed after polishing. Polishing into or below the L5 level can cause irreparable damage to the active device areas.

FIG. 2C is a schematic cross sectional view showing a possible further state 203 for the wafer of either FIG. 2A or 2B wherein further polishing occurs and a dishing effect causes deplanarization of the wafer surface. It is assumed that polishing continued in either of FIGS. 2A and 2B beyond the target level, L4.2 and as a result of the excessive-polishing, the tops (224.3) of the nitride pads 224" are now at level L4.3" and tops (222") of the trench-fill material 223"are now at yet deeper level L4.4". Respective tops 224.3 and 222" of the oxide and nitride regions are no longer co-planar because the utilized CMP slurry preferentially removes oxide (223") at a faster rate than it removes nitride (224"). When the oxide tops descend (to level L4.4) below the nitride tops (which are at L4.3), the effect is called dishing. The change in topography can cause an initial decrease in rotational friction followed by a subsequent increase. The decrease may occur because effective surface area shrinks. The subsequent increase may occur because of more complicated mechanisms such as debris accumulation in the dished out areas and surface tension effects. Although the exact causes are not always clearly known, the point is that friction tends to become unpredictable once the dishing effect begins. Therefore use of friction to detect the point where dishing starts is rarely reliable in a mass production setting.

Returning to FIG. 3A, the present inventors have discovered through the course of many experiments that the illustrated decrease of friction in plot section 340 of FIG. 3A can be a consistently repeated and used as a reliable and precise marker for detecting the transition from the L4.1' stage to the L4.2' stage. (The L4.2' thickness is measured from the bottoms L5 of the nitride pads to their tops at various regions across the wafer surface so as to get a measure of cross-wafer uniformity.) The experiments used different ceria-based slurry formulations and used different initial thicknesses between the L3.1' level (FIG. 2B) and the target L4.2 level. The repeatably reliable marker was consistently found by automated machine-implemented means despite intentionally made changes of the ceria-based slurry formulations and intentional use of different initial thicknesses.

More specifically, the present inventors have discovered that after attainment of the first-order planarization (332) at time point $t_4$, the friction curve will continue to rise slowly and/or it will plateau (337') as second-order or higher planarization is realized. Then, starting around time point $t_6$, the slope of the friction curve will temporarily turn negative after peak point 341. (The peak could alternatively be a peak plateau rather than just one point 341.) Somewhere along the negatively-sloped part 342 of the friction curve (after the peak point 341 or peak plateau), there will be one or more points 345 that consistently and with relative precision, demark a polishing depth level, L4.15 that is a fixed distance away from the target depth level, L4.20. Therefore, if an pre-specified overpolish is commenced (triggered) at the time when the reliable demarcation point 345 is detected, and if the overpolish is continued for a correspondingly pre-specified time duration $T_{67}$, and if the polishing is discontinued at the end 367 of that pre-specified duration $T_{67}$, then a mass production-wise consistent thickness of fully exposed silicon nitride (e.g., 224" of FIG. 2C) should be seen, with statistical reliability, across each mass produced wafer, and from one wafer to the next. Experimental results that substantiate this are provided below in tabular form.

It is to be understood that the corresponding, pre-specified time duration, $T_{67}$, for the post-trigger overpolish can be obtained from an empirically-developed database. The database may specify the $T_{67}$ value as a function of one or more polishing parameters such as: (a) the L4.2 or other target depth to be attained; (b) the slurry type (e.g., ceria versus silica) and/or specific slurry composition to be used; (c) the workpiece type (e.g., pre-polished STI versus other) and/or the specific workpiece material composition; (d) the polish contact pressure (P) to be used; (e) pad velocity ($V_1$); (f) carrier velocity ($V_2$); (g) slurry feed rate (F); (h) contact surface temperature (T); and (g) any other polishing parameters as may be appropriate for the database to better specify the optimum $T_{67}$ overpolish value, for example, nitride pad composition and/or thickness L5–L4.2 if that is relevant for the desired target depth. Additionally or alternatively, the database may specify the $T_{67}$ value as a function of the specific detection method or detection method type used for identifying the reliable demarcation point 345. It will be seen later, below that slightly different end-point detection algorithms may be used for identifying a corresponding, demarcation point 345 and that the $T_{67}$ overpolish value fetched for each such different, trigger-defining algorithm may be slightly different from the optimum $T_{67}$ overpolish values fetched from the database for others of such different, trigger-defining algorithms.

The reason, incidentally, that silicon nitride pads (224) need to have their upper surfaces essentially fully exposed is because they will next be subjected to a wet etch that selectively removes the nitride material. Unfortunately, the wet etch (e.g., a diluted HF acid solution) may also undesirably etch away some exposed oxide, but at a slower rate. Consistent thickness is desired for the CMP-exposed silicon nitride pads so that the duration of the wet etch process (e.g., HF acid) can be limited to not much more than is necessary to remove the precisely controlled thicknesses of the CMP-exposed silicon nitride pads. Undesirable damage may occur to other parts of the workpiece if the wet etch is maintained for longer periods of time. The preferred outcome at the end of CMP polishing, therefore, is to have all the silicon nitride pads essentially fully exposed at their upper surfaces and to have the respective thicknesses of the nitride pads be consistent across each wafer, with a thickness variation of say, no more than about 50 Å–100 Å, and more preferably no more than about 20 Å–30 Å for one particular application where nominal nitride pad thickness is around 850 Å. (The acceptable variation tends to be application specific.) Experiments have demonstrated that this is possible with design of an appropriate end-point algorithm that can consistently and reliably detect one or more signature points (e.g., point 345 of curve 301) that occur soon after the peak 341 of the friction curve in the transition from the second-order planarization phase to the state where the sacrificial pad layer (e.g., nitride) starts to become more and more exposed.

Figure 3B:
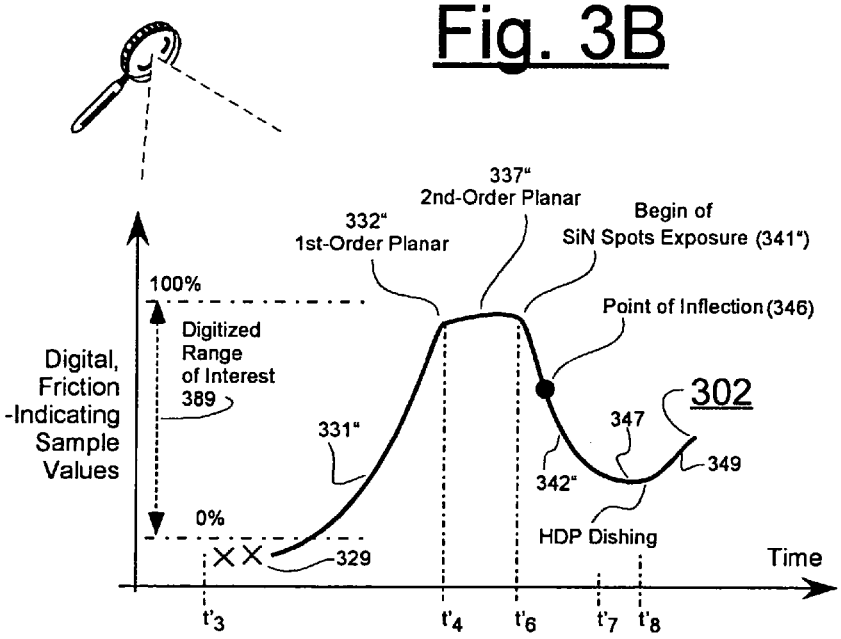
FIG. 3B is a time versus friction plot for showing at a higher-order approximating level what happens as an increasing number of silicon nitride surface spots become exposed in the transition from polishing essentially only silicon oxide to also polishing silicon nitride pad areas.

Referring to FIG. 3B, further aspects of the pre-peak and post-peak parts of an STI friction curve 302 are explored. Among the digital, friction-indicating sample signals that are received by the computer (programmable machine), there are those which have relative magnitudes within a particular window of interest 389 and are worthy of greater examination. The window of interest 389 may cover the tail part of the dramatic rise 331" that represents switching to first-order planarization as well as the transition point 332" where the first-order planarization is attained and second-order planarization begins. Sample values 329 that appear earlier along the dramatic rise portion 331" are typically of no interest. It is undesirable to have too wide a window of interest 389 for digital processing because the resolution of the measurement window is finite (e.g., 24 bits of precision) and it is wasteful to use up part of the window's finite range on sample values that are of limited usefulness.

The observation window 389 may be fashioned to also cover at least the tail part of that portion 337" of the STI friction curve 302 that represents attainment of second-order planarization or higher planarization. The observation window 389 should be fashioned to at least capture the portion 341" of the STI friction curve that represents the beginning of exposure of silicon nitride surface spots. An empirically-derived time delay may be utilized to avoid collecting sample values prematurely along rise portion 331" (before and shortly after $t'_3$). Portion 341" and parts slightly beyond (along down-slope 342") are of greater value than preceding portions 331", 332" and 337" of the STI friction curve 302. Between curve regions 341" and 347, the friction versus time plot has a generally negative slope at least for a short but substantial period of time.

The occurrence of this generally, negatively-sloped curve portion 342" is believed to correlate to the polishing process exposing increasingly larger areas of low-friction, silicon nitride and to also correlate to the polishing process simultaneously removing the higher-friction, silicon oxide from those same regions of growing area. It is believed that near the bottom 347 of this generally negatively-sloped curve section 342", a variety of competing mechanisms come into play to cause friction to once again begin to increase. The increase in friction may be due in part to the level planarization becoming better as the tops of the silicon oxide areas and silicon nitride areas come into essential co-planarity with one another. A dishing mechanism can come into play shortly afterwards to erode the tops of exposed silicon oxide areas away faster than the tops of exposed silicon nitride areas. Contact area decreases as a result of dishing, and normally this may produce reduced friction. However, when a ceria-based slurry is used, the polishing debris from the dishing mechanism and/or slurry surfactant effects appear to produce an overall increase in friction as is represented by rising portion 349 of curve 302.

As a result of the various, friction increasing and decreasing mechanisms coming into effect between the time ($t'_6$) that the first spots of exposed silicon nitride appear to the time ($t'_8$) that dishing takes over, the friction versus time curve 302 has a somewhat S-shaped profile during that phase, with a point of inflection 346 occurring somewhere in between. (The region or point of inflection 346 is that part of the $t'_6$–$t'_8$ curve where the negative slope stops becoming more negative and starts becoming less negative. The second derivative of friction with respect to time is about equal to zero in the region of inflection 346.) Experiments have shown that points on the curve after the peak region 341" and up to and including the region of inflection 346 can serve as consistent demarcation points for precisely triggering a timed, continuance of polish, where the timed continuance ends consistently and almost precisely with the stopping of ceria-based chemical mechanical polishing at the desired target plane, L4.2.

Figure 4A:
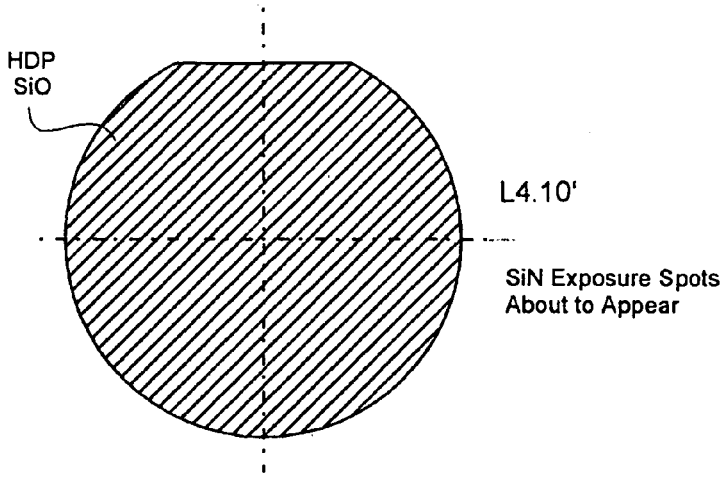
FIG. 4A is a schematic top view of a wafer that is being polished and has essentially only silicon oxide exposed at its top surface.
Figure 4B:
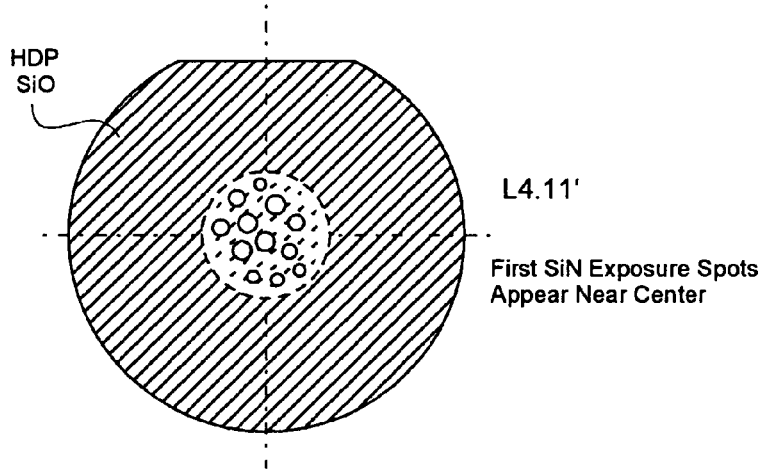
FIG. 4B is a schematic top view showing the wafer of FIG. 4A as a first crop of exposed silicon nitride surface spots appear during CMP polishing.
Figure 4C:
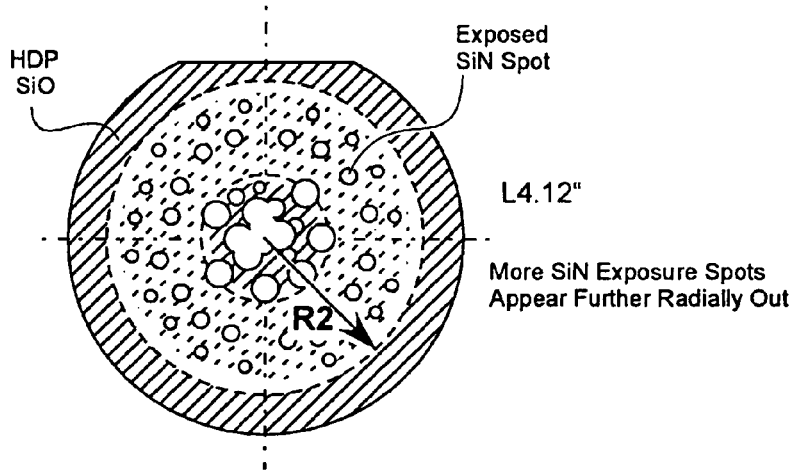
FIG. 4C is a schematic top view showing the wafer of FIG. 4B as a larger and more evolved crop of exposed silicon nitride spots appear during CMP polishing.

Reference is made to FIGS. 4A–4C to explain why it is believed that the curve points after the peak region 341" and up to and including the region of inflection 346 can serve as consistent demarcation points. FIG. 4A is a schematic view looking at the slurry-contacting surface 401 of a wafer as that wafer is being polished, where the illustrated surface 401 has a very thin layer of essentially only silicon oxide exposed. The lower-friction, pad layer is still buried underneath surface 401 of the wafer. The polishing progress is denoted as L4.10 to indicate that the top surface 401 will soon start to show spots of silicon nitride peaking through as the polishing very soon progresses to next level, L4.11 (FIG. 4B).

Referring to FIG. 4B, the polishing has now progressed to level L4.11 and some random, but substantially sized, spots of exposed silicon nitride begin to appear. Some of the exposed spots are larger while others are relatively smaller. There is usually some amount of randomness in this initial exposure process. Not all parts of the wafer will immediately show substantially sized spots of exposed nitride. Often, the polishing tool will have a preferred pattern of exposure progression. In the tools that were used in the experiments described herein, the tools appeared to show a preference for exposing silicon nitride pad spots first, more so near the center of the wafer, and then progressively, further spots that are located more radially outward over time. In other words, the larger and more easily observable of the spots (if polishing is stopped and an observation is made) seemed to be first clustered near the center of the wafer as is shown in FIG. 4B. As polishing continued beyond this first spotting phase 402, the smaller nitride spots in the center appeared to merge with one another to define larger areas of exposed silicon nitride near the center of the wafer. At the same time, new small spots of exposure began to randomly appear further radially out from the center.

FIG. 4C is a schematic view looking at the slurry-contacting surface 403 of the same wafer after that wafer has continued to be polished, and now a substantially larger portion of the slurry-contacting surface 403 has exposed silicon nitride spots of various, substantive sizes and distributions, with the bigger exposures nearer to the center of the disc-shaped wafer. The more advanced polishing progress is denoted as L4.12 to indicate that the top surface 403 will soon be at state L4.15 where the rate of reduction of friction is becoming statistically uniform rather than being driven by more so by random appearances of just some spots here and there. Since spot exposure growth occurs on a radially expanding basis, it may be understood that for a given effective radius, R2, the area of newly exposed silicon nitride will be growing as the square of the currently effective radius, R2 until that growth front, R2, intersects with, roughly, the outer radius of the wafer. (The wafer does not usually have exposable silicon nitride pads all the way to its very edge.) It may be understood from the progression of FIGS. 4A–4C that waves of greater and greater, substantial nitride exposure sweep from the center towards the periphery, and as they do so, the rate of friction reduction will become less of a random process and it will tend to stabilize into a relatively predictable pattern until disruptive, other mechanisms (e.g., higher-orders of planarization and/or dishing, see FIG. 2C) take hold and become predominant. The start of the latter switch in mechanisms is usually signaled by the point or region of inflection 346 shown in FIG. 3B. Thus, detection of the point or region of inflection 346 or an earlier signature point along curve 302, but after peak 341, can be used as a relatively precise trigger point for beginning the timeout phase $T_{67}$ (FIG. 3A). It is within the contemplation of the disclosure to use a plurality of signature points rather than just one for defining the trigger time, where the plural signature points occur after the peak (341") and before the inflection zone 346 and where the plural signature points are used in combination for defining the triggering time at which the $T_{67}$ timeout phase will commence. It is further within the contemplation of the disclosure to use the peak region 341" as well for defining the trigger time. However, as is illustrated by FIG. 4A, it is believed that the friction curve is more subject to random fluctuations near its peak friction point because not enough, large silicon nitride spots have yet been exposed and spots are emerging sporadically. Therefore, it is not as statistically reliable to use the peak point 341" as a trigger for mass production purposes as it is to use points that are further down the negative slope.

Figure 5A:
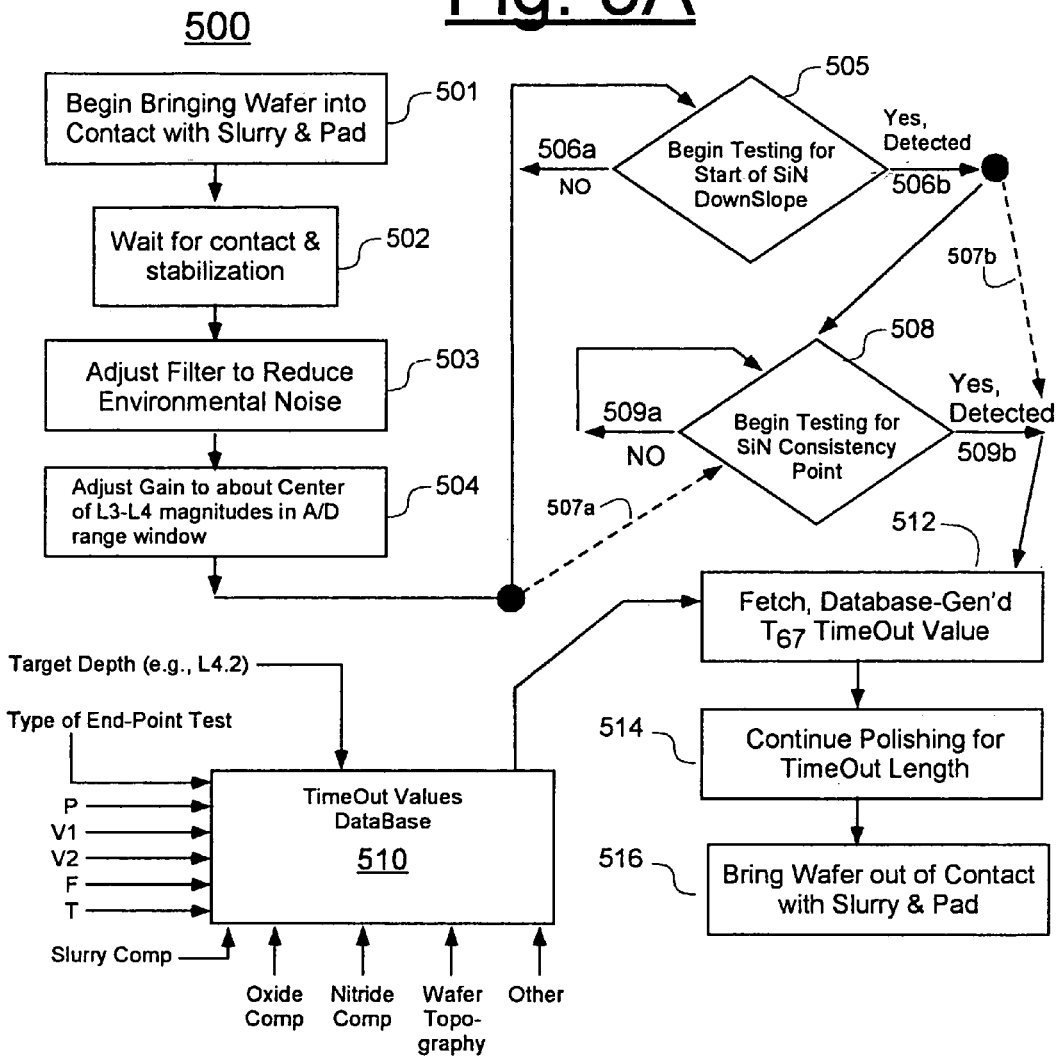
FIG. 5A is a flow chart of an automated method in accordance with the disclosure for achieving consistent planarization stoppage while using a torque-based end-point detecting apparatus of a form similar to that shown in FIG. 1C.

Referring to FIG. 5A, a machine-implemented method 500 for determining when CMP polishing should stop is shown by way of a flow chart. At step 501, the computer 180" (e.g., that of FIG. 1C, but now programmed in accordance with the present disclosure) causes an STI wafer (e.g., 220 of FIG. 2B) to come into frictionally rubbing engagement with the pad and slurry. In step 502, the computer waits for detection of frictional contact and stabilization of the interaction (the beginning of level L3.1 engagement). In step 503, the computer may make optional, adaptive adjustments to the noise filtering functions of circuit 181 to improve signal-to-noise ratio. In step 504, the computer makes the assumption that the L3.1, first-order planarization level has been achieved (this is to be contrasted with step 194 of FIG. 1D) and the control software 185" begins to adjust the gain and optional offset of output signal 171 so as to bring the L3 and/or L4 magnitudes roughly into the middle of, or lower quarter of the full A/D range window 189. This convergence may appear in a shape similar to waveform portion 194*a* of plot 188.

After the gain and/or offset adjustments have been finalized, one version of process 500 continues on to step 505. An alternate embodiment of process 500 instead takes dashed path 507*a* directly to step 508. In step 505, the received (172) sample values are tested to detect the start of a friction down-slope which indicates the beginning of exposure of silicon nitride or other sacrificial spots (e.g., state 402 of FIG. 4B). In one embodiment, step 505 is carried out with a single run of the slope-classifying algorithm (560) of FIG. 5C with the width ($W_{scw}$) of the slope-classifying window (see FIG. 5B which will be detailed below) set at about 2 seconds or more and the relative height ($H_{scw}$) set at about 10%/100% (=10 units) or greater. If the beginning of the friction down-slope is detected by step 505, then in one embodiment, process 500 continues on to step 508 by way of path 506*b*. In an alternate embodiment dashed path 507*b* is instead taken directly to step 512.

If the beginning of the friction down-slope is not detected within step 505, and a predefined time maximum ($t_{max}$, not shown) has not yet run out, path 506*a* is taken in order to loop back to step 505 and keep looking for the beginning of the friction down-slope which signals the beginning of exposure of silicon nitride spots. If the predefined time maximum ($t_{max}$) expires while loop 506*a* is being followed, an appropriate error handling function is invoked. The error handling function will typically include stopping the polishing.

Figure 5B:
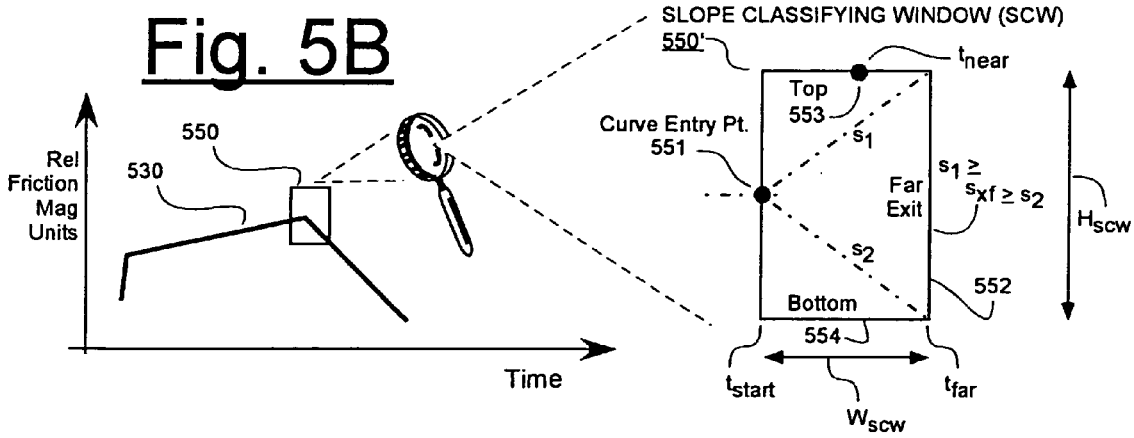
FIG. 5B introduces a technique which uses a slope-classifying window.
Figure 5C:
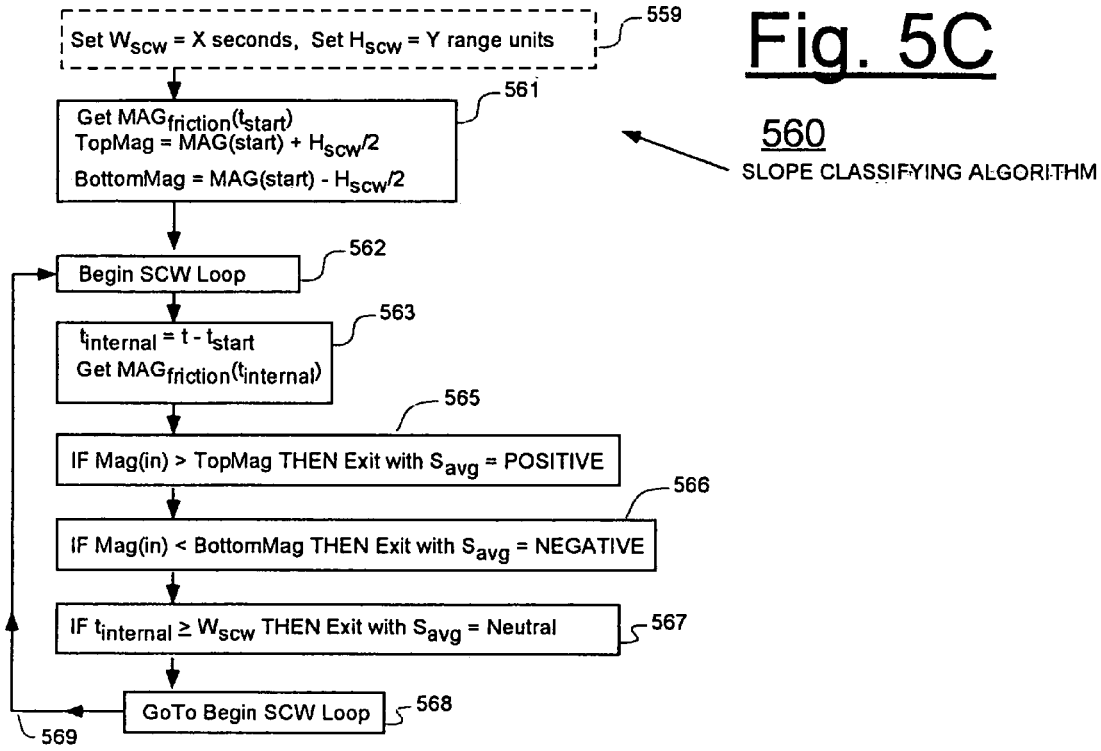
FIG. 5C is a flow chart of an automated slope classifying method.

Although the slope-classifying algorithm of FIG. 5C is mentioned here, it is not the only way to detect the beginning (341, FIG. 3A) of the friction down-slope (342) which signals the beginning of exposure of silicon nitride spots. Step 505 does not have to be limited to use of the algorithm 560 of FIG. 5C. Other machine-implemented algorithms may be used so long as they include a means for discounting transient, negative slopes of friction and/or transient and noise-infected samples which are not consistently and reliably indicative of a substantial beginning of exposure of silicon nitride spots. Examples of other techniques for detecting the beginning (341) of the friction down-slope (342) include, detecting the friction peak point or plateau (341 of FIG. 3A) and waiting until the friction value thereafter descends by a predefined, relative magnitude and/or waiting until the friction value thereafter descends by a predefined fraction of the relative magnitude of the detected peak point or plateau (341).

Another possible way to automatically detect the beginning (341) of the friction down-slope (342) is to detect a minimum point in the second derivative of indicated friction with respect to time. The friction would have had a small positive slope on curve portion 337" of FIG. 3B as second-order or higher planarization is achieved. When the first substantial number of substantially-sized, silicon nitride spots appear, the slope will suddenly go negative. The second derivative ($d^2f/dt^2$) should drop to a minimum at this juncture. Afterwards, the second derivative ($d^2f/dt^2$) should rise towards zero as the process continues towards the inflection point 346 identified in FIG. 3B. Yet another possible way to automatically detect the beginning (341) of the friction down-slope (342) is to wait for a predefined time-delay before beginning one of the above testing methods.

Once the indication is generated for signaling the beginning (341) of substantial nitride exposure, path 506*b* may be taken to separate step 508. The beginning of substantial nitride exposure is not necessarily the best demarcation point for beginning (triggering) a timed overpolish (step 514). There can be one or more signature points further down the downslope (342) that, from a mass production viewpoint, can serve as more precise and/or more consistent and more reliably found signature points for triggering the overpolish timeout ($T_{67}$). One example of a better point is the point of inflection 346 identified in FIG. 3B. Step 508 may employ a filtered algorithm for determining when the second derivative ($d^2f/dt^2$) of friction versus time crosses zero. Alternatively or additionally, step 508 may employ the multi-window process 570 of FIG. 5D (e.g., wait for a point where at least 3 successive negative slopes have been detected by a corresponding set of 3 or more successive, slope-classifying windows—FIG. 5B.) Alternatively or additionally, step 508 may wait for friction to reduce by a predetermined percentage relative to the friction reading found at step 505 (e.g., a drop of about 10%). Alternatively or additionally, step 508 may wait for the first derivative of friction (df/dt) relative to time to drop below a predetermined threshold.

Figure 5D:
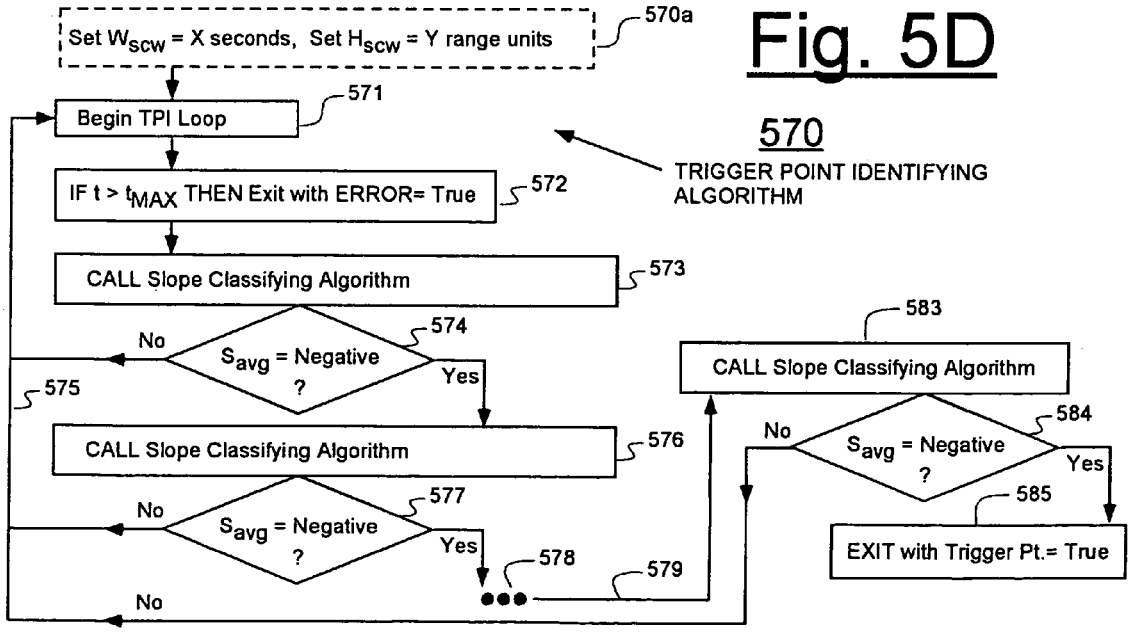
FIG. 5D is a flow chart of an automated method in accordance with the disclosure for finding a consistent exposure point.

In one embodiment, step 508 (which finds the trigger point) is carried out with a run of the trigger-point identifying algorithm 570 of FIG. 5D. This algorithm 570 may be run with the width ($W_{scw}$) of each of its plural slope-classifying windows (see FIG. 5B) set to about 1 second or more and the height ($H_{scw}$) of each set at about 5%/100% (=5 relative units). More generally, the width ($W_{scw}$) of each of the plural slope-classifying windows may be set in the range of about 10% or less, and better yet 5% or less of the expected time duration of the polishing until the polishing reaches the to-be-identified end point (345). The expected duration can be as large as 2 minutes or more, or as small as 30 seconds depending on application. The heights ($H_{scw}$) of the respective slope-classifying windows are often empirically established because gain and/or offset of step 504 are variable and therefore magnitude is relative.

Figure 6:
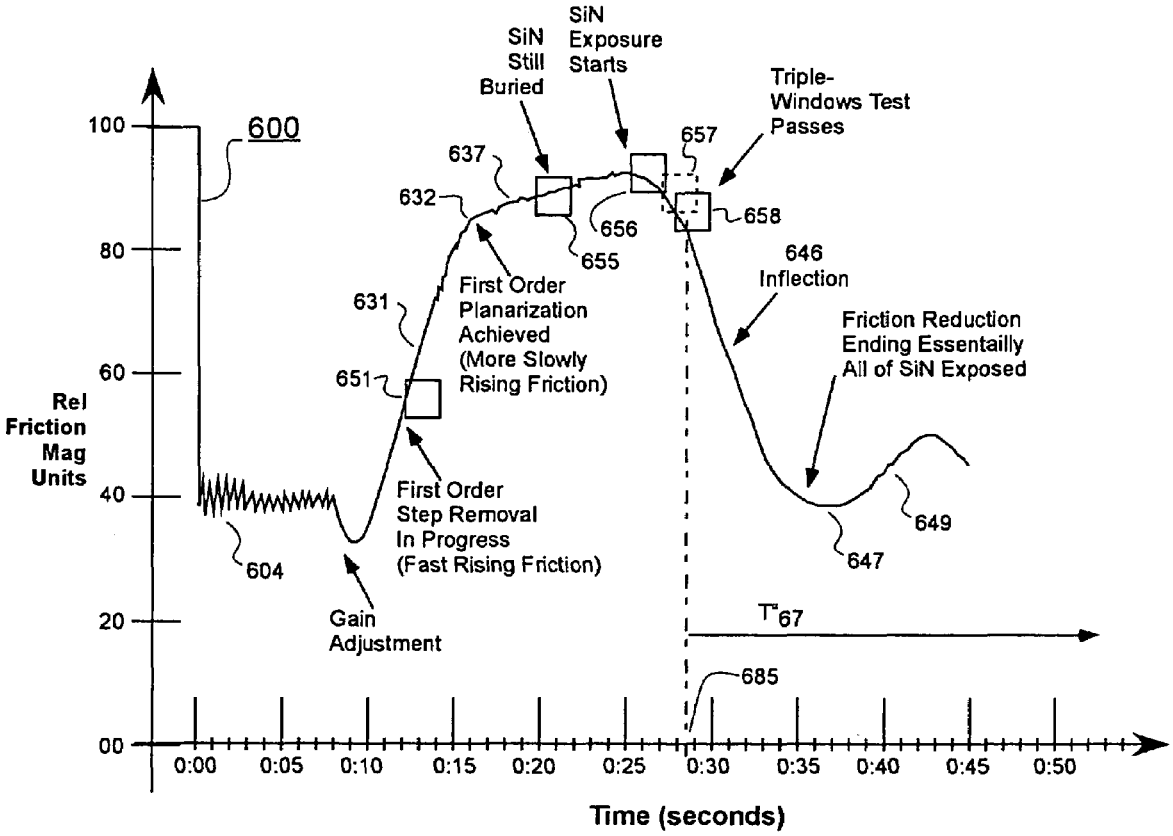
FIG. 6 is a plot showing results of one experimental run that 3-window identifying algorithm to identify the trigger point for start of a overpolish.

FIG. 6 shows a plot of a run which used a $W_{scw}$ of about 1 second for each slope-classifying window and a $H_{scw}$ setting of about 5% of the displayed 100% magnitude range. The friction-indicating signal was obtained from the platen motor and the friction-indicating range was defined in relative magnitude units extending over an offset window whose resolvable measurements are marked as a range extending from 0% to 100%. Contact pressure between the workpiece and slurry started the clock running at t=00 seconds. Automated gain and offset adjustments 604 for the displayed waveform 600 occurred in roughly, the first 9 seconds. Using empirically derived experience, the gain and offset adjustments 604 were frozen in a manner that allowed the displayed waveform 600 to show at least the tail part of the dramatic rise portion 631 of the friction samples, with the displayed rise starting at about or slightly below the 40% mark of the relative friction window range.

After the gain and offset adjustments have been frozen at about t=10 seconds in FIG. 6, an optional first running of the slope classifying window at 651 (at about t=12 seconds) returns a positive slope indication. At about t=15 seconds, the CMP process achieves first-order planarization 632. The displayed waveform 600 then transitions to a more-slowly rising mode 637. A subsequent running of the slope classifying window 655 (at about t=20 seconds) returns a neutral slope indication. It is to be understood that the respective outputs of classifying windows 651 and 655 each corresponds to a NO (506*a*) result from step 505 of FIG. 5A. If desired, an optional time-out may be used to block slope testing until after, say, about t=15 seconds so as to avoid possible false positives from large noise spikes that may be present at the beginning of a polish job.

At about t=25 seconds, a further slope classifying window, 656 is started in the experiment of FIG. 6 and this one returns an indication of a negative slope at about t=27 seconds. The negative slope indication corresponds to a Yes (506*b*) result from step 505 of FIG. 5A. The next two successive, slope classifying window runs, 657 and 658 correspond to execution of step 508 for this particular embodiment (the one used in FIG. 6). Each of the latter slope classifying runs, 657 and 658 (same $H_{scw}$ and $W_{scw}$ as that of window 656), returns a negative slope indication. The trigger point 685 is set as the exit time from slope-classifying window 658. In the illustrated experiment, the trigger point occurred at about t=28.5 seconds. An empirically-predefined overpolish time, $T''_{67}$ was then used to complete exposure of the silicon nitride pad areas. For the illustrated experiment of FIG. 6, the overpolish time, $T''_{67}$ was 25 seconds. (This overpolish time value was, of course, unique to the conditions of the experimental run of FIG. 6 and the desired target depth. Different overpolish time values may be called for in different situations.)

Referring again to FIG. 5A, step 512 represents the fetching of an appropriate, overpolish time, $T_{67}$ from a corresponding database 510 and step 512 also represents the responsive triggering of that fetched overpolish time, $T_{67}$. The triggering occurs when step 508 provides an indication (509*b*) that the trigger point has been reached. Although the flow chart of FIG. 5A shows the fetching of $T_{67}$ as occurring after step 508, in practice, the overpolish time value, $T_{67}$ may be fetched prior to the time that test step 508 produces the Yes indication (509*b*) and the Yes indication (509*b*) may be used to immediately trigger the running of the timeout timer. (In many instances it does not matter whether the $T_{67}$ value is fetched before or after because the computer(s) are running so fast that the delay associated with the fetch (e.g., milliseconds) of $T_{67}$ is negligible.

The specific overpolish time value, $T_{67}$ that is fetched can be fixed or it can be generated as a function of one or more of a variety of parameters. The latter option is indicated in FIG. 5A by the plural inputs entering database computer 510. The parameters that define $T_{67}$ may include: (a) a specifier of the L4 target level; (b) a specifier (P) of the current contact pressure between the slurry and workpiece; (c) a specifier (V1) of the current platen velocity; (d) a specifier (V2) of the current carrier velocity; (e) a specifier (F) of the current slurry feed rate; and (f) a specifier (T) of the current temperature inside the tool chamber and/or at the contact interface between the slurry and workpiece.

Additionally or alternatively, the parameters that define $T_{67}$ may include a specifier of the kind of end-point detection tests being used in steps 505 and/or 508. The discussed specifiers may be numeric values representing physical magnitudes and/or they may be constituted by any other indicia that indicates a choice between two or more options. It has already been explained that the present disclosure contemplates using a variety of different tests for detecting a start (341) of the exposure down-slope (342) and/or for identifying an appropriate trigger point (345). The 3-successive windows test shown in FIG. 6 (at 656, 657, 658) is just one example which shows a combined way to detect the start of the down-slope and pick a subsequent trigger point. An alternate test might use 4 or more successive windows, possibly with different window dimensions, for identifying the trigger point. Thus, the specific location of the trigger point along the exposure downslope (e.g., 342 of FIG. 3A) may change depending on which tests are used for identifying a start (341) of the exposure down-slope (342) and/or for identifying an appropriate trigger point (345). The corresponding specific overpolish time value, $T_{67}$ may vary accordingly. (It will be shorter if the picked trigger point is later in time, and $T_{67}$ will be longer if the picked trigger point is earlier in time.)

Additionally or alternatively, the parameters that define $T_{67}$ may include a specifier of the kind or of the specific CMP slurry that is being used just before, and/or during the overpolish duration $T_{67}$. Slurry composition can affect the polish rate and/or the detected friction values just as can others of the mentioned parameters (L4, P, V1, V2, F, T). The parameters that define $T_{67}$ may additionally or alternatively include a specifiers of the oxide composition, of the sacrificial pad composition (e.g., nitride) and/or of the current wafer surface topography. These parameters can also affect the polish rate and/or the detected friction values. The setting of the overpolish time value, $T_{67}$ should be responsive to parameters which affect how closely the actual stop of polish will come to the desired target level (e.g., L4.2 of FIGS. 2A–2B). Step 514 carries out the overpolish for duration $T_{67}$ and step 516 brings the wafer out of effective contact with the slurry and pad at the end of duration $T_{67}$.

Referring to FIG. 5B, some further details are provided concerning detecting algorithms. In one set of embodiments, a waveform classifying window 550 is effectively placed over a region of interest on a given friction versus time plot 530 in order to characterize the region of interest as being representative of a sharp upslope, or of a sharp downslope, or of a slope that is of intermediate magnitude (between specified thresholds $s_1$ and $S_2$). The magnitude of friction in plot 530 may be given in terms of relative, friction magnitude units, such as on an offsettable scale of 0% to 100%. Detailed example 550' shows a slope-classifying window 550' that is rectangular in shape, has a curve entry point 551 at the midpoint of its left side, has a first curve-exit boundary 552 at its right side, and has respective second and third, curve-exit boundaries, 553 and 554 at its top and bottom sides. Window width, $W_{scw}$ represents the time difference between time of curve entry ($t_{start}$) at point 551 and the longest possible time ($t_{far}$) for the curve to exit from the far side 552 of the slope-classifying window (scw). Window height, $H_{scw}$ represents the relative magnitude difference between the top and bottom sides, 553 and 554 of the window 550'. Two slopes, $s_1$ and $S_2$, are defined by hypothetical lines drawn from the curve entry point 551 to the far ends of the top and bottom, curve-exit boundaries, 553 and 554. In the case where the curve entry point 551 is kept in the middle of the left side, slope $s_1$ is simply half of $H_{scw}/W_{scw}$. Slope $S_2$ is similarly equal to $-H_{scw}/\{2W_{scw}\}$. Therefore, $s_1$ and $s_2$, are respective positive and negative threshold values for indicating whether a given region of the friction curve (530) has a relatively neutral average slope, or a more positive slope, or a more negative slope. In one embodiment, slope s2 is approximately −1.5 relative magnitude units per second. In alternate embodiments, the curve entry point 551 is shifted up or down along the left side of the rectangle 550', and the values of slopes s1 and s2 change accordingly.

A curve which exits from the top 553 of the slope-classifying window 550' can be characterized as having an average slope greater than s1 in the time domain between $t_{start}$ and the time ($t_{near}<t_{far}$) of exit. A curve which exits from the bottom 554 of the slope-classifying window 550' (as is shown in the example of 550 to the left) can be characterized as having an average slope less than s2 in the time domain between $t_{start}$ and the time, $t_{near}$ of exit. A curve which exits from the far side 552 of window 550' can be characterized as having an average slope between s1 and s2 inclusively. In one set of embodiments, the characterizations are simplified to indicating that the studied curve portion has a relatively positive, or relatively negative, or relatively neutral slope.

FIG. 5C flow charts a machine-implementable algorithm 560 that may be used for characterizing a studied curve section in accordance with FIG. 5B. Step 559 is optional. It establishes the window width, $W_{scw}$ and/or window height, $H_{scw}$ as may be appropriate prior to starting the classifying run at step 561. The $W_{scw}$ parameter my specify sample time in terms of elapsed seconds or ticks from when time measuring was commenced. The $H_{scw}$ parameter my specify relative sample magnitude in terms of the relative units used by the gain-adjusted and/or offset observation window (e.g., 389 of FIG. 3B). In step 561, the starting magnitude of relative friction is read (172) from a circuit such as 181 (FIG. 1C) and the relative top and bottom magnitudes of the slope-classifying window are calculated accordingly so as to place the curve entry point (551 of FIG. 5B) at the middle of the left side of the slope-classifying window (SCW). It is within the contemplation of the disclosure to alternatively place the curve entry point elsewhere along the left side of the SCW and to calculate values for TopMAG and BottomMAG accordingly in step 561.

Step 562 begins the slope-classifying window loop. In step 563, a localized time, $t_{internal}$ is defined relative to absolute time, t. (The localized time, $t_{internal}$ may be used to calculate actual average slope, if the latter value is needed.) The next magnitude of relative friction is also read. In step 565, the just input (read) magnitude of relative friction, MAG(in) is compared against the TopMAG value computed in step 561. If MAG(in) is greater, an exit is taken from run 560 with an indication that the slope is relatively positive. If not, run 560 continues to step 566 where the just input magnitude, MAG(in) is compared against the BottomMAG value computed in step 561. If MAG(in) is smaller, an exit is taken from run 560 with an indication that the slope is relatively negative. If not, run 560 continues to step 567 where the current localized time, $t_{internal}$ is compared against the window width, $W_{scw}$. If $t_{internal}$ is equal to or greater than $W_{scw}$, an exit is taken from run 560 with an indication that the slope is relatively neutral. If not, run 560 continues to step 568. Step 568 returns control (569) back to the top of the loop 562. In step 563, the localized clock is advanced, the next sample is input, and steps 565–568 are repeated as appropriate.

FIG. 5D flow charts a machine-implementable algorithm 570 that may be used for detecting an uninterrupted succession of negatively-sloped curve sections. Step 570*a* is optional. It establishes the window width, $W_{scw}$ and/or window height, $H_{scw}$ as may be appropriate prior to starting the succession detecting run at step 571. These values may be set elsewhere. With proper setting of the $W_{scw}$ and $H_{scw}$ variables, algorithm 570 may be used as a trigger-point identifying algorithm. In one embodiment, $W_{scw}$ is set in the range of about 1 second to 5 seconds (for a 2 minute polish) and $H_{scw}$ is set to about 5% of full A/D range in order to identify an overpolish trigger-point using three successive ones of the slope-classifying windows described for FIG. 5B. Once again, the $W_{scw}$ and $H_{scw}$ variable settings are usually found from empirical testing. The empirical tests are structured to show what ranges of $W_{scw}$ and $H_{scw}$ will avoid false positive detections (due to environmental noise) of where the true down-slope begins (indicating exposure of nitride spots) and will also provide a reliable time point (685) that can be consistently used on a mass production basis to achieve the desired target level (L4.2) at the end of the $T_{67}$ overpolish.

Step 571 begins the trigger-point identifying (TPI) loop. In step 572, the current time, t is compared against a predefined, maximum polish time, $t_{MAX}$. If a trigger point is not found within $t_{MAX}$, then it is determined that something has gone wrong. An exit is taken, polishing is stopped and an appropriate error-handling routine is invoked. Step 573 calls a slope classifying algorithm such as 560 of FIG. 5C. (Alternate slope classifying algorithms could be used instead.) Test step 574 determines whether the studied curve region is relatively negative or not. If not (NO), path 575 is followed back to the top 571 of the TPI loop. If YES, control passes to step 576. Step 576 makes a next successive call to a slope classifying algorithm such as 560 of FIG. 5C, placing the scw entry point (551) at about the exit point of the scw (e.g., 550') used in step 573. Test step 577 determines whether the studied curve region is relatively negative or not. If not (NO), path 575 is followed back to the top 571 of the TPI loop. If YES, control passes along path 578–579 to an optional one or more further successive calls to a slope classifying algorithm such as is represented at 583. Optional test step 584 determines whether the studied curve region is relatively negative or not. If not (NO), path 575 is followed back to the top 571 of the TPI loop. If YES, control passes to exit step 585. Exit step 585 returns a true value for the trigger-point-found state. In response to this, the subsuming algorithm (e.g., 500 of FIG. 5A) should immediately trigger the $T_{67}$ timeout for the post-trigger point polish (e.g., 514–516 of FIG. 5A). Dotted portion 578 of FIG. 5D is to be understood as representing an optional number, N of further callings of a corresponding N instances of an appropriate same or different slope classifying algorithms and the corresponding N invocations of a branch-back test such as at nodes 574 or 577. The trigger-point identifying algorithm 570 may have as few as only one calling, or two successive callings of respective slope classifying algorithms followed by the corresponding invocations of the branch-back test (e.g., 574). Alternatively, another embodiment of the trigger-point identifying algorithm 570 may require three or more successive callings of respective slope classifying algorithms followed by the corresponding invocations of the branch-back test (e.g., 574).

Referring again to FIG. 6, the illustrated run 600 was carried out with a 3-successive windows version of algorithm 570 of FIG. 5D where $W_{scw}$ and $H_{scw}$ were set to respective same values for each of the 3 windows. The automated gain and offset adjustment 604 was empirically set to capture the peak friction value (the maximum of slow climb 637) at about 90% of full scale and to capture the tail portion of the steep rise 631 starting at around 40% of full scale. Invocation of algorithm 570 at around t=12 seconds returns a continuing stream of positive slope results until first-order planarization is achieved at about point 632 of the friction curve. Window 651 is representative of a positive slope finding by the algorithm. Window 655 is representative of a neutral slope finding by the algorithm. Window 656 is representative of a first return of a negative slope result by the slope classifying algorithm. A branch-back test 574 in algorithm 570 (detailed above) then proceeds to a step 576 instead of back to the top-of-loop step 571. Window 657 is representative of a successive return of a second negative slope result by the slope classifying algorithm. A corresponding branch-back test 577 (FIG. 5D) then proceeds to a step 583 instead of back to the top-of-loop step 571. Window 658 is representative of a successive return of a third negative slope result by the slope classifying algorithm. Corresponding branch-back test 584 in FIG. 5D then proceeds to exit step 585 instead of back to step 571. The exit at step 585 of FIG. 5D corresponds to the trigger time 685 (at about t=28 seconds) where curve 600 exits out of window 658 and polishing for timeout duration $T''_{67}$ begins.

In further experimental runs (not shown), similar to those of FIG. 6, polishing was stopped at around the time of window 655 and cross-sectional views of the wafers were taken with a scanning electron microscope (SEM). It was observed that about 600 Å of HDP-oxide still remained above the silicon nitride pads. Exposure had not yet started. In yet further experimental runs (not shown), similar to those of FIG. 6, polishing was stopped at around the exit time 685 of window 658 and cross-sectional views of the wafers were taken via SEM. It was observed that the SiN pads appeared to be fully exposed at about the depth of the tops of the pads as seen in the experiments where polishing stopped at around the time of window 655. This verified that the 3-windows algorithm was correctly triggering at the point where the nitride pads were essentially fully exposed.

Yet further experimental runs (not shown), similar to those of FIG. 6, were made with oxide coatings of different thicknesses and topographies to verify that the trigger point algorithm produced relatively consistent results independently of starting factors such as initial oxide thickness and initial surface topography. For one set of experiments, the initial oxide thickness (HDP oxide) was about 6000 Å as measured from STI trench bottoms. A first CMP polish was conducted with a silica-based slurry for 35 seconds. This was followed by an end-point triggered overpolish of $T_{67=25}$ seconds using the 3-windows algorithm with $W_{scw}$ and $H_{scw}$ set to the same respective values as noted above. Statistical analysis of the exposed nitride pads showed a consistent, mean nitride pad thickness across the wafers of 858 Å. This was very close to the theoretically expected result. For a next set of experiments, the initial oxide thickness (HDP oxide) was about 7700 Å as measured from STI trench bottoms. A first CMP polish was again conducted with a silica-based slurry for 35 seconds. This was followed by an end-point triggered overpolish of $T_{67=25}$ seconds using the same 3-windows algorithm. Statistical analysis of the exposed nitride pads showed a consistent, mean nitride pad thickness across the wafers of 860 Å (just 2 Å greater than the first results). This demonstrates that the 3-windows algorithm provides consistent mass production results with good immunity to starting point variations.

In another set of experiments (Table 1), both oxide and nitride thicknesses were measured for consistency after using the same 3-windows algorithm for end-point triggering of the $T_{67=25}$ seconds overpolish. End-point polishing of patterned STI wafers was conducted with the same ceria-based slurry as in the baseline experiments. The patterned wafers were again constituted by Shallow Trench Isolation (STI) wafers having a starting thickness of greater than 6000 Å of HDP oxide. These wafers were also pre-polished to a smaller thickness (6000 Å) before being supplied to the tool under test. In the experiment of Table 1, the ending oxide thickness value for wafer #0 was unfortunately not obtained. End of polish nitride thickness also showed good results for the end-point algorithm that was being tested by the experiment of Table 1.

TABLE 1

| | Ceria-slurry Polish | | | | |
|---|---|---|---|---|---|
| STI Wafer No. after pad break in | Measured time to end point detection (seconds) | Ending Oxide Thick (Å) | Oxide Thick Range (max–min, Å) | Ending Nitride Thick (Å) | Nitride Thick Range (max–min, Å) |
| 0 | 52.7 | n/a | n/a | 849 | 20 |
| 1 | 56.7 | n/a | n/a | | n/a |
| 2 | 47.9 | n/a | n/a | | n/a |
| 3 | 46.2 | n/a | n/a | | n/a |
| 4 | 46.6 | n/a | n/a | | n/a |
| 5 | 45.9 | 5140 | 167 | 849 | 19 |
| 6 | 47.9 | n/a | n/a | | n/a |
| 7 | 47.7 | n/a | n/a | | n/a |
| 8 | 51.8 | n/a | n/a | | n/a |
| 9 | 50.3 | n/a | n/a | | n/a |
| 10 | 54.0 | 5158 | 149 | 847 | 24 |
| 11 | 55.8 | n/a | n/a | | n/a |
| 12 | 52.3 | n/a | n/a | | n/a |
| 13 | 44.3 | n/a | n/a | | n/a |
| 14 | 56.6 | n/a | n/a | | n/a |
| 15 | 50.1 | n/a | n/a | | n/a |
| 16 | 49.9 | n/a | n/a | | n/a |
| 17 | 55.7 | n/a | n/a | | n/a |
| 18 | 53.7 | n/a | n/a | | n/a |
| 19 | 53.4 | n/a | n/a | | n/a |
| 20 | 56.5 | 5144 | 172 | 849 | 19 |
| 21 | 51.9 | n/a | n/a | | n/a |
| 22 | 53.1 | n/a | n/a | | n/a |
| 23 | 53.0 | n/a | n/a | | n/a |
| 24 | 60.0 | n/a | n/a | | n/a |
| AVG of 0–23 | 51.42 | n/a | n/a | n/a | n/a |

The above Table 1 demonstrates that a relatively consistent thickness of silicon nitride was obtained over a batch of wafers with good consistency across each wafer (nitride thickness variance is about 19 Å–24 Å across the wafers) using the end-point algorithm of FIG. 6. Measured time to end-point detection varied around a 51.4 second average by as much as about ±5 seconds (not counting sample 24) and yet the resultant nitride pad thickness remained consistently around 847–849 Å.

In yet another set of experiments (Table 2), oxide and nitride thicknesses were again measured for consistency after using the same 3-windows algorithm for end-point triggering of the $T_{67}$=15 seconds overpolish. End-point polishing of patterned STI wafers was conducted with the same ceria-based slurry as in the baseline experiments. The patterned wafers were again constituted by Shallow Trench Isolation (STI) wafers having a starting thickness of greater than 6000 Å of HDP oxide. These wafers were also pre-polished to a smaller thickness (6000 Å) before being supplied to the tool under test. In the experiment of Table 2, end of polish nitride thickness also showed good results for the end-point algorithm that was being tested.

TABLE 2

| | | Ceria-slurry Polish | | |
|---|---|---|---|---|
| Wafer ID | Endpoint Time, s | OP time | Nova Nitride | Nova Oxide |
| 0 | 48.2 | 15 | 860 | 5112 |
| 1 | 50.5 | 15 | 859 | 5091 |
| 2 | 44.6 | 15 | 862 | 5114 |
| 3 | 47.2 | 15 | 850 | 5106 |
| 4 | 40.2 | 15 | 855 | 5108 |
| 5 | 41.5 | 15 | 857 | 5161 |
| 6 | 40.8 | 15 | 858 | 5179 |
| 7 | 41.7 | 15 | 862 | 5148 |
| 8 | 42.8 | 15 | 859 | 5137 |
| 9 | 42.1 | 15 | 860 | 5116 |
| 10 | 44.8 | 15 | 853 | 5069 |
| 11 | 44.7 | 15 | 862 | 5167 |
| 12 | 44.6 | 15 | 857 | 5141 |
| 13 | 46.4 | 15 | 856 | 5132 |
| 14 | 45.2 | 15 | 850 | 5146 |
| 15 | 47.6 | 15 | 855 | 5110 |
| 16 | 48.8 | 15 | 863 | 5069 |
| 17 | 46.9 | 15 | 862 | 5163 |
| 18 | 46.9 | 15 | 866 | 5151 |
| 19 | 48.8 | 15 | 864 | 5165 |
| 20 | 45.0 | 15 | 865 | 5146 |
| 21 | 47.8 | 15 | 856 | 5164 |
| 22 | 45.4 | 15 | 865 | 5157 |
| 23 | 51.0 | 15 | 863 | 5131 |
| 24 | 50.3 | 15 | | 5176 |
| | | AVE | 859 | 5134 |
| | | WTW Range | 16 | 110 |

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, and/or use of equivalent functional steps for steps described herein. Such insubstantial variations are to be considered within the scope of what is contemplated here. Moreover, if plural examples are given for specific means, or steps, and extrapolation between and/or beyond such given examples is obvious in view of the present disclosure, then the disclosure is to be deemed as effectively disclosing and thus covering at least such extrapolations.

Reservation of Extra-Patent Rights, Resolution of Conflicts, and Interpretation of Terms After this disclosure is lawfully published, the owner of the present patent application has no objection to the reproduction by others of textual and graphic materials contained herein provided such reproduction is for the limited purpose of understanding the present disclosure of invention and of thereby promoting the useful arts and sciences. The owner does not however disclaim any other rights that may be lawfully associated with the disclosed materials, including but not limited to, copyrights in any computer program listings or art works or other works provided herein, and to trademark or trade dress rights that may be associated with coined terms or art works provided herein and to other otherwise-protectable subject matter included herein or otherwise derivable herefrom.

If any disclosures are incorporated herein by reference and such incorporated disclosures conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

Unless expressly stated otherwise herein, ordinary terms have their corresponding ordinary meanings within the respective contexts of their presentations, and ordinary terms of art have their corresponding regular meanings within the relevant technical arts and within the respective contexts of their presentations herein.

Given the above disclosure of general concepts and specific embodiments, the scope of protection sought is to be defined by the claims appended hereto. The issued claims are not to be taken as limiting Applicant's right to claim disclosed, but not yet literally claimed subject matter by way of one or more further applications including those filed pursuant to 35 U.S.C. §120 and/or 35 U.S.C. §251.

What is claimed is:

1. A method for determining when to stop chemical mechanical polishing (CMP) of a workpiece, where the workpiece has a first-to-be-polished layer composed of a first material and an underlying layer structured to include a plurality of sacrificial pads composed of a second material, where planarized areas of the second material exhibit less friction against a utilized CMP slurry than do like-sized and planarized areas of the first material, the stop time determining method comprising:

(a) while the first-to-be-polished layer is being polished by said utilized CMP slurry and before the sacrificial pads are substantially exposed, testing a friction-indicating signal that is indicative of magnitude of friction between the workpiece and a slurry holder to detect a first change in slope versus time, where the slope of the friction-indicating signal after the first change has a negative value that is more negative than a predefined, threshold negative slope and where the slope of the friction-indicating signal after the first change indicates that exposure of the sacrificial pads has substantially begun;

(b) after the first change in slope is detected by said first-recited testing and while said utilized CMP slurry continues to be used for polishing of both the first and second materials, further testing the friction-indicating signal to detect a signature point in the friction-indicating signal, where the signature point is indicative of a more progressed, but not yet complete exposure of the sacrificial pads, and where the more progressed exposure constitutes a substantially greater exposure of the sacrificial pads to the utilized CMP slurry than the exposure of the pads when the first change in slope of the friction-indicating signal was detected.

2. The stop time determining method of claim 1 wherein: each of said first and second testings is automatically executed by a programmable machine.

3. The stop time determining method of claim 1 wherein: the utilized CMP slurry includes ceria particles.

4. The stop time determining method of claim 3 wherein: the first material includes a silicon oxide and the second material includes a silicon nitride.

5. The stop time determining method of claim 4 wherein: the first-to-be-polished layer is at least partially planarized prior to said testing to detect the first change of the slope of the friction-indicating signal.

6. The stop time determining method of claim 1 wherein:

(a) the first-recited testing includes use of a slope-classifying window (scw) having first and second threshold slopes over a time period corresponding to a width of the SCW and where the width of the SCW is set so that the lesser of said first and second threshold slopes is about equal to the predefined, threshold negative slope.

7. The stop time determining method of claim 6 wherein:

(a.1) the width and height of the slope-classifying window are set such that second threshold slope is about minus 1.5 relative magnitude units per second or more negative.

8. The stop time determining method of claim 6 wherein:

(b) the further testing includes use of a further slope-classifying window (SCW) having respective first and second threshold slopes over a time period corresponding to a width of the SCW and where the width of the SCW is set so that the lesser of said first and second threshold slopes is about equal to the predefined, threshold negative slope.

9. The stop time determining method of claim 1 and further comprising:

(c) receiving the friction-indicating signal as a digitally sampled signal having at least one of an adjustable gain and an adjustable offset, where after adjustment of at least one of the adjustable gain and adjustable offset, digital samples of the received friction-indicating signal occupy a substantial portion of a relative magnitude range extending from 0% to 100% of the relative magnitude range; and (d) freezing adjustment, if any, of the adjustable gain or adjustable offset of the received friction-indicating signal so that at least some of the received digital samples which are received just before commencement of the first-recited testing will occupy a lower portion of the relative magnitude range, where the lower portion is below the 50% level of the relative magnitude range.

10. The method of claim 1 and further comprising:

(c) using the detected signature point to define a triggering time point from which a time-limited further polishing will occur for a corresponding, limited amount of time; and (d) causing the time-limited further polishing to occur for the defined, limited amount of time.

11. The method of claim 10 and further comprising:

(e) fetching a signal representing the limited amount of time from a database, where the database causes the fetched signal to be a function of at least a first specifier which specifies what post-polish thickness is desired for the second material.

12. The method of claim 11 and further wherein:

(e.1) the database causes the fetched signal to be a function of at least a second specifier which specifies what type of type of testing will be used in at least one of steps (a) and (b).

13. The method of claim 12 and further wherein:

(e.1) the database causes the fetched signal to be a function of at least a third specifier which specifies what type of CMP slurry will be utilized.

14. The method of claim 13 and further wherein:

(e.2) the database causes the fetched signal to be a function of at least a fourth specifier which specifies what contact pressure will be present between the slurry and workpiece during the testing of at least one of steps (a) and (b).

15. The method of claim 14 and further wherein:

(e.3) the database causes the fetched signal to be a function of at least a fifth specifier which specifies what relative rubbing velocity will be present between the slurry and workpiece during the testing of at least one of steps (a) and (b).

16. The method of claim 15 and further wherein:

(e.4) the database causes the fetched signal to be a function of at least a sixth specifier which specifies what feed rate will be used for feeding the utilized slurry to the workpiece.

17. The method of claim 10 and further comprising:

(e) fetching a signal representing the limited amount of time from a database, where the database causes the fetched signal to be a function of at least a first specifier which specifies what type of slurry will be utilized during at least one of steps (a) and (b).

18. The method of claim 10 and further comprising:

(e) fetching a signal representing the limited amount of time from a database, where the database causes the fetched signal to be a function of at least a first specifier which specifies what first material will constitute the first-to-be-polished layer.

19. The method of claim 10 and further comprising:

(e) fetching a signal representing the limited amount of time from a database, where the database causes the fetched signal to be a function of at least a first specifier which specifies what second material will constitute the sacrificial pads.

20. A method for timely stopping chemical mechanical polishing (CMP) of a semiconductor wafer, where the wafer has a first-to-be-polished layer composed of a first material and an underlying layer structured to include a plurality of sacrificial pads composed of a second material, where planarized areas of the second material exhibit less friction against a utilized CMP slurry than do like-sized and planarized areas of the first material, the timely stopping method comprising:

(a) after polishing with said utilized CMP slurry has begun and after exposure of the sacrificial pads has substantially begun and while said utilized CMP slurry continues to be used for polishing of both the first and second materials, testing a friction-indicating signal that is indicative of magnitude of friction between the workpiece and the utilized slurry to detect a signature point in the friction-indicating signal, where the signature point is indicative of a more progressed, but not yet complete exposure of the sacrificial pads, and where the more progressed exposure constitutes a substantially greater, and less random, exposure of the sacrificial pads to the utilized CMP slurry than the first-recited exposure of the pads.

21. The timely stopping method of claim 20 and further comprising:

(b) prior to the first-recited testing of step (a) but while the first-to-be-polished layer is being polished by said utilized CMP slurry, pre-testing the friction-indicating signal to detect a preliminary change in slope versus time, where the slope of the friction-indicating signal after the preliminary change is less than a predefined, threshold slope and where the slope of the friction-indicating signal after the preliminary change indicates that substantial exposure of the sacrificial pads has or is about to begin.

22. The timely stopping method of claim 20 wherein: the utilized CMP slurry includes ceria particles.

23. The timely stopping method of claim 20 wherein: the first material includes a silicon oxide and the second material includes a silicon nitride.

24. The timely stopping method of claim 20 wherein: the first-to-be-polished layer is at least partially planarized prior to the beginning of said polishing with said utilized CMP slurry.

25. The timely stopping method of claim 20 wherein:

(a.1) the first-recited testing includes using of a slope-classifying window (SCW) at least twice in succession, where the used SCW has first and second threshold slopes defined over a time period corresponding to a width of the SCW and where the width of the SCW is set so that the lesser of said first and second threshold slopes is equal to a predefined, threshold negative slope.

26. A polishing tool for carrying out chemical mechanical polishing (CMP) of one or more supplied workpieces, where a given one of the supplied workpieces can have a first-to-be-polished layer composed of a first material and the given workpiece can further have an underlying layer structured to include a plurality of sacrificial pads composed of a second material, where planarized areas of the second material exhibit less friction against a to-be-utilized CMP slurry than do like-sized and planarized areas of the first material, the polishing tool comprising:

(a) a motor that powers frictional rubbing of the given workpiece with a utilized CMP slurry;

(b) a signal generator that generates a friction-indicating signal that is indicative of magnitude of friction between the given workpiece and the utilized slurry;

(c) an automated, polish stopping machine, operatively coupled to receive the friction-indicating signal, the polish stopping machine including:

(c.1) timed overpolish means for causing time-limited, continued polishing of the workpiece for a corresponding, limited amount of time followed by cessation of the polishing;

(c.2) overpolish triggering means, operatively coupled to the timed overpolish means to timely trigger the overpolish means, the overpolish triggering means including:

(c.2a) first testing means for correspondingly first testing a received, friction-indicating signal that is indicative of magnitude of friction between the workpiece and the utilized slurry after polishing with said utilized CMP slurry has begun and after, somewhat random, first exposure of the sacrificial pads has substantially begun and while said utilized CMP slurry continues to be used for polishing of both the first and second materials, the first testing being for detection of a signature point in the friction-indicating signal, where the signature point is indicative of a more progressed, but not yet complete, second exposure state of the sacrificial pads, and where the more progressed and second exposure state constitutes a substantially greater, and less random, exposure of the sacrificial pads to the utilized CMP slurry than the first exposure of the pads.

27. The polishing tool of claim 26 and further wherein:

(c.2b) the overpolish triggering means includes second testing means for correspondingly second testing the received, friction-indicating signal to detect a preliminary change in slope versus time of the friction-indicating signal, where the slope of the friction-indicating signal after the preliminary change is less than a predefined, threshold slope and where the slope of the friction-indicating signal after the preliminary change indicates that said first exposure of the sacrificial pads has or is about to begin.

28. The polishing tool of claim 26 and further wherein:

(b.1) the signal generator includes at least one of adjustable gain and adjustable offset means for causing the generated friction-indicating signal to have magnitudes extending within a corresponding and predefined, range after said first exposure of the sacrificial pads has begun; and (b.2) the at least one of the adjustable gain and adjustable offset means is stopped from further adjusting the corresponding gain and offset of the generated friction-indicating signal before said first testing of the friction-indicating signal commences.

29. The polishing tool of claim 26 and further wherein:

(c.1a) the timed overpolish means includes a database for defining the limited amount of time so that the defined limited amount of time will be a function of at least one of:

(c.1a1) a first specifier which specifies what post-polish thickness is desired for the sacrificial pads;

(c.1a2) a second specifier which specifies what type of testing will be used in the first testing means;

(c.1a3) a third specifier which specifies what type of CMP slurry will be utilized while the first testing means is testing the friction-indicating signal;

(c.1a4) a fourth specifier which specifies what contact pressure will be present between the slurry and workpiece during the first testing of the friction-indicating signal;

(c.1a5) a fifth specifier which specifies what relative rubbing velocity will be present between the slurry and workpiece during the first testing of the friction-indicating signal;

(c.1a6) a sixth specifier which specifies what feed rate will be used for feeding the utilized slurry to the workpiece;

(c.1a7) a seventh specifier which specifies what first material will constitute the first-to-be-polished layer;

(c.1a8) an eighth specifier which specifies what second material will constitute the sacrificial pads; and (c.1a9) a ninth specifier which specifies what one or more topographies will be respectively present in the first-to-be-polished layer and/or the underlying layer.

30. Manufactured instructing signals for causing a correspondingly instructable machine to carry out a machine-implemented, polishing control algorithm during chemical mechanical polishing (CMP) of one or more supplied workpieces, where a given one of the supplied workpieces can have a first-to-be-polished layer composed of a first material and the given workpiece can further have an underlying layer structured to include a plurality of sacrificial pads composed of a second material, where planarized areas of the second material exhibit less friction against a to-be-utilized CMP slurry than do like-sized and planarized areas of the first material, the control algorithm causing the correspondingly instructable machine to carry out steps including:

(a) waiting for stabilized polishing contact to develop between a workpiece and the utilized CMP slurry;

(b) adjusting one or both of an adjustable gain and an adjustable offset for a generated friction-indicating signal that is indicative of magnitude of friction between the given workpiece and the utilized slurry;

(c) testing the adjusted, friction-indicating signal for occurrence of a signature point in a waveform of the friction-indicating signal, where the signature point is indicative of a more progressed, but not yet complete, exposure state of the sacrificial pads, and where the more progressed exposure state constitutes a substantially greater, and less random, exposure of the sacrificial pads to the utilized CMP slurry than an initially detectable exposure of the pads; and (d) in response to detection of said signature point, triggering a time-limited, continued polishing of the workpiece for a corresponding, limited amount of time followed by cessation of the polishing.

31. A computer readable medium having a computer readable database embodied in the computer readable medium for generating a signal defining a limited amount of time after endpoint detection for which chemical mechanical polishing is to continue on a supplied workpiece where the workpiece has a first-to-be-polished layer composed of a first material and an underlying layer structured to include a plurality of sacrificial regions composed of a second material, where planarized areas of the second material exhibit less friction against a utilized CMP slurry than do like-sized and planarized areas of the first material, said computer readable database being responsive to at least two of:

(c.1a1) a first specifier which specifies what post-polish thickness is desired for the sacrificial pads;

(c.1a2) a second specifier which specifies what type of testing will be used in the first testing means of the end-point determiner;

(c.1a3) a third specifier which specifies what type of CMP slurry will be utilized while the first testing means is testing the friction-indicating signal;

(c.1a4) a fourth specifier which specifies what contact pressure will be present between the slurry and workpiece during the first testing of the friction-indicating signal;

(c.1a5) a fifth specifier which specifies what relative rubbing velocity will be present between the slurry and workpiece during the first testing of the friction-indicating signal;

(c.1a6) a sixth specifier which specifies what feed rate will be used for feeding the utilized slurry to the workpiece;

(c.1 a7) a seventh specifier which specifies what first material will constitute the first-to-be-polished layer;

(c.1a8) an eighth specifier which specifies what second material will constitute the sacrificial pads; and (c.1a9) a ninth specifier which specifies what one or more topographies will be respectively present in the first-to-be-polished layer and/or the underlying layer.

* * * * *